US006248494B1

(12) United States Patent
Yamazaki et al.

(10) Patent No.: US 6,248,494 B1
(45) Date of Patent: Jun. 19, 2001

(54) TONER FOR DEVELOPING AN ELECTROSTATIC IMAGE AND A PRODUCTION METHOD THEREOF, AND AN IMAGE FORMING METHOD

(75) Inventors: Hiroshi Yamazaki; Ken Ohmura; Tomomi Oshiba; Meizo Shirose; Shigenori Kouno, all of Hachioji (JP)

(73) Assignee: Konica Corporation

( * ) Notice: Subject to any disclaimer, the term of this patent is extended or adjusted under 35 U.S.C. 154(b) by 0 days.

(21) Appl. No.: 09/452,075

(22) Filed: Nov. 30, 1999

(30) Foreign Application Priority Data

Dec. 2, 1998 (JP) ..... 10-342839
Feb. 25, 1999 (JP) ..... 11-047912

(51) Int. Cl.[7] ..... G03G 9/097
(52) U.S. Cl. ..... 430/110; 430/111; 430/125
(58) Field of Search ..... 430/111, 110, 430/125, 97

(56) References Cited

U.S. PATENT DOCUMENTS 5,305,061 * 4/1994 Takama et al. ..... 430/111
5,809,378 * 9/1998 Kukimoto et al. ..... 430/111
5,914,210 * 6/1999 Demizu et al. ..... 430/110
5,976,750 * 11/1999 Hagi et al. ..... 430/111

OTHER PUBLICATIONS

Diamond, Arthur S. (editor) Handbook of Imaging Materials, New York: Marcel–Dekker, Inc. pp. 160–163, 1991.*

* cited by examiner

*Primary Examiner*—Christopher Rodee
(74) *Attorney, Agent, or Firm*—Jordan B. Bierman; Bierman, Muserlian and Lucas

(57) ABSTRACT

A toner for developing an electrostatic image is disclosed. The toner comprises colored particles containing a resin and a colorant, the volume average particle diameter of said colored particles is 3 to 9 $\mu$m, the shape coefficient of said colored particles, which is described by the formula below, is 1.3 to 2.2, and the ratio of toner particles having a shape coefficient of 1.5 to 2.0 is at least 80 percent by number.

$$\text{Shape coefficient}=[(\text{maximum diameter}/2)^2\times\pi]/(\text{projection area})$$

A developer and image forming method employing the toner are also disclosed.

19 Claims, 2 Drawing Sheets

TONER FOR DEVELOPING AN ELECTROSTATIC IMAGE AND A PRODUCTION METHOD THEREOF, AND AN IMAGE FORMING METHOD

FIELD OF THE INVENTION

The present invention relates to a toner used for developing an electrostatic image, an electrostatic image forming method, which is employed in an electrophotographic method, an electrostatic printing method, and the like, an electrostatic image forming apparatus, as well as a developer material and a process cartridge which are employed in said method and apparatus. The present invention relates specifically to an image forming method and an image forming apparatus which utilize a system in which after development and transfer, non-transferred toner remaining on a latent image holding body is recovered employing a cleaning process and is recycled, and a developer material and a process cartridge which are advantageously employed for such.

BACKGROUND OF THE INVENTION

Generally, an electrostatic latent image is formed on a photoreceptor possessing photoconductivity, employing various means, and subsequently, said latent image is developed employing a toner. The resulting toner image is transferred to a transfer material such as a sheet of paper, if desired, and thereafter, copied and printed materials are obtained by fixing the transferred image employing heat, pressure, and the like.

In the above-mentioned process, all of the toner on the photoreceptor is not transferred but about 5 to 20 percent by weight of the toner remain on the photoreceptor. Such residual toner (non-transferred toner) on the photoreceptor has been collected employing a cleaning process, fed to the exterior of the apparatus as toner waste, which has generally not been able to be reused. However, in recent years, the demand for copiers and printers has increased, and further, the demand for high-speed copiers and printers is increasing by leaps and bounds. In such high-speed apparatuses, a large volume of toner waste is generated, which, when disposed of improperly, may pollute the environment. Under such situations, in recent years, investigations on recycling of the above-mentioned toner waste have been widely made, that is, recycling of the toner collected by a cleaning process. If the toner waste can be recycled, the following advantages may be expected; supplied toner can be sufficiently used and the toner can be used effectively. Further, it is possible to eliminate a storage area for storing the toner waste and to reduce the overall dimensions of the apparatus.

However, when conventional toner waste is returned to a development process and is reused as a developer material, adverse effects such as a decrease in reflection image density, an increase in background staining or reversal staining, toner scattering, and the like have resulted.

In response to the demand of such toner recycling, various inventions have been made.

For example, Japanese Patent Publication Open to Public Inspection No. 6-75423 proposes a recycled toner of which properties are improved by broadening the molecular weight distribution of the toner to increase high molecular weight components. Furthermore, Japanese Patent Publication Open to Public Inspection No. 6-75423 proposes a recycled toner of which properties and fixability are improved in such a manner that molecular weight distribution component of toner binders exhibits two peaks and both polypropylene and amide wax are incorporated into the toner.

However, in the above mentioned toners, which are obtained by improving the conventional pulverized toner, undesirable fine toner powder is formed during pulverization, and it is difficult to remove said fine powder employing normal classification means. As a result, fine toner powder remains in the toner. When the toner comprising such a fine toner powder is employed, after development, it is difficult to transfer the fine toner powder on a photoreceptor onto a transfer material due to its strong adhesion to the photoreceptor. When such a toner is fed into a toner recycling system, the fine toner powder is collected by cleaning and returned to the development section. Thus, it is likely to be accumulated in the development section. In the development section, such fine toner powder tends to be fused with the carrier and the like, resulting in a so-called spent phenomenon and further resulting in fusion to the development sleeve and the like. As a result, the charge providing capability of the carrier and the like decreases, resulting in a decrease of the charge amount of toner, and an increase in a charge amount distribution (increase in the amount of weakly chargeable toner, and the like). Finally, background staining tends to occur.

As described above, improvements in the recycled adaptability of the toner prepared by pulverization are limited. At present, toner is not available, which satisfies required needs for such recycled toner, that is, which satisfies needs of developability, fixability at low temperature, lowered offsetting tendency, lowered blocking tendency, and the like, and constantly produces excellent images when toner waste is recycled and reused.

Further, as a means to overcome problems of the above-mentioned fine toner powder, Japanese Patent Publication Open to Public Inspection Nos. 60-31117, 60-107656, and 60-117255 proposes suspension-polymerized toners, which are spherical and have a narrow particle size distribution. However, when these suspension-polymerized toners are recycled, together with external additives such as silica and the like, the external additives are buried into the toner surface due to its spherical shape. As a result, the fluidity of the recycled toner is markedly degraded and the transfer ratio of the toner to a transfer material such as a sheet of paper or the like decreases, and image quality tends to be degraded.

Regarding the shape of toner particles, in order to solve the above-mentioned problems, it is proposed that the toner is deformed so that the toner has an uneven surface rather than a spherically smooth surface. In Japanese Patent Publication Open to Public Inspection No. 7-26207, a method to solve these problems is proposed, in which the degree of shape deformation of toner is defined employing a shape coefficient.

In said patent, methods are disclosed in which modification is carried out by fine resin particles adhere onto the surface of suspension-polymerized toner, or deformation is carried by allowing suspension-polymerized toner to swell while immersed in a solvent, followed by drying under reduced pressure.

However, when the deformation is carried out by fine resin particles adhere onto the surface of said suspension-polymerized toner, fine resin particles adhered onto the toner surface are released from the surface during the agitation of the developer material in the development unit, and charges concentrate onto the fine resin particles on the surface, which broadens the charge amount distribution. As a result, toner scattering on finished images is increased to deteriorate the definition of text images. In addition, the properties of the surface-deformed toner, prepared by immersing a suspension-polymerized toner into a solvent, tend to be unstable due to differences in production lots, and problems related to unstable image quality occur.

Furthermore, the surface of a photoreceptor is coated with a resin. Therefore, specifically, the performance of a resin is critical and resins having excellent durability have been desired. Recently, employed as resins to improve these characteristics have generally been polycarbonate resins (hereinafter referred to as bisphenol Z polycarbonate) in which bisphenol Z (polycarbonate in which the central carbon atom of bisphenol A is modified with a cyclohexyl ring) is used as the main skeleton, which are used as a binder in the surface layer. As a result, the surface abrasion of a photoreceptor is minimized during the development process as well as the cleaning process, and it becomes difficult to remove the toner adhered onto the photoreceptor surface.

Namely, when such a photoreceptor is employed in an image forming apparatus using a recycling system, it is impossible to remove fine toner particles adhered onto the photoreceptor surface. Further, due to causes that fine toner particles adhered on the photoreceptor may not be removed and a portion of these fine toner particles adhere and stain the charging member and the like, in the finished images, a phenomenon tends to occur in which image defects consisting of black streaks or many white spots are formed over the entire image.

On the other hand, electrophotography is employed not only in monochromatic copiers, but also in the field of computer output terminal printers, color copiers, color printers, and the like. As electrophotography is increasingly employed, demand for image quality has been raised.

In order to improve overall image quality, various proposals have been made in which image quality is improved by decreasing the size of toner particles, and no effort will be made to enumerate them. As a technique corresponding to the decrease in the size of toner particles, so-called polymerization methods for toners are known. One of them is a production method of a polymerized toner, comprised of a fusion of resin particles with colorant particles, described in Japanese Patent Publication Open to Public Inspection No. 63-186253, and the like, which discloses a technique capable of making particles of undefined shape. However, when only this technique is employed, it is possible to make particles of undefined shape but is not capable of making shape distribution stable. As a result, since the shape distribution is broad, a chargeability distribution also broadened, resulting in unstable development. Further, during transfer, problems with a decrease in transfer efficiency occur due to the effect of the chargeability distribution.

Furthermore, as the particle diameter decreases in the particle diameter distribution, the adhesion power of the particle itself to a carrier becomes stronger under the same charge amount due to the decrease in the weight of the particle itself. Owing to that, in a toner having the distribution of chargeability, a difference in detaching from a charge providing member such as a carrier tends to occur. As a result, the developability is not stabilized, and further, during transfer, a problem with uneven transfer tends to occur.

Further, in conventional diameter-decreased toner, many toner particles having a high van der Waals force exist. Thus charge providing capability decreases, and weakly chargeable toner as well as excessively charged toner are generated.

As a result, when employed over a long period of time, a background staining results on printed images. Accordingly, problems occur in which a development unit or carrier in two-component development is stained, and subsequently its durability decreases.

A diameter decreased toner results in a charge rising problem. In order to solve this problem, as proposed in Japanese Patent Publication Open to Public Inspection No. 9-96919, investigations have been carried out in which the specific surface area of toner particles is increased to improve the charging rise. When this method is employed, the charging rise is fairly improved. However, even in this case, the uniformity of shape is not sufficient in conventional toner, which results in problems with development stability, transfer stability, and the like. As a result, variation in its performance is large, and specifically, in development in which high resolution is required, the resulting performance is not sufficient.

SUMMARY OF THE INVENTION

An object of the present invention is to provide a toner for developing an electrostatic image, which has a uniform shape and a small particle diameter, as well as one which meets the requirement for the enhancement of the resolution of images, and an image forming method employing the same, which stably yields high resolution over a long period of time.

Another object of the present invention is to provide an electrostatic image forming method and an electrostatic image forming apparatus which are suitable for a recycling system to reuse toner waste, and a developer material as well as a process cartridge employed for these. Namely, still another object of the present invention is to provide an electrostatic image forming method and an electrostatic image forming apparatus which are capable of forming uniform images without resulting in staining on a photoreceptor, as well as in forming background stain over a long period of time, while employing a toner recycling system, and a developer material as well as a process cartridge employed for these.

The present invention and embodiments thereof will be described.

In a toner for developing an electrostatic image comprising colored particles containing a resin and a colorant, the volume average particle diameter of said colored particles is 3 to 9 $\mu$m, the shape coefficient of said colored particles, which is described by the formula below, is 1.3 to 2.2, and the ratio of toner particles having a shape coefficient of 1.5 to 2.0 is at least 80 percent by number.

$$\text{Shape coefficient}=[(\text{maximum diameter}/2)^2\times\pi]/\text{projection area}$$

The toner preferably comprises the colored particles and an external additive.

A preferable example of the external additive is inorganic particles.

Preferable number average primary particle diameter of the inorganic particles is 5 to 500 nm.

The toner comprises the inorganic particles having number average primary particle diameter of 5 to 50 nm and the inorganic particles having number average primary particle diameter of more than 50 and not more than 500 nm.

The colored particles are preferably prepared by fusing resin particles in an water-based medium.

The toner wherein the colored particles are prepared by drying by stream of heated air after fusing resin particles in an water-based medium.

A developer material comprising said toner is employed in an image forming method in which images are visualized by bringing an electrostatic latent image, formed on a photoreceptor, into contact with a developer material layer formed on a developer material conveying member, or in an image forming method in which an electrostatic latent image, formed on a photoreceptor, is faced with a developer material layer in a non-contact state, and is visualized while a toner for developing the electrostatic image, is only allowed to jump.

Said toner may be produced employing a production method of a toner for developing an electrostatic image, which comprises a process in which at least resin particles as well as colorant particles undergo association in a water-based medium.

In said production method, after at least resin particles as well as colorant particles undergo association in a water-based medium, a process is preferably included, which dries said associated particles employing an air flow dryer.

By making particles of a uniform shape, uniform chargeability is likely obtained during development. As a result, an electrostatic latent image may be faithfully developed. Further, since toner having a stabilized electric potential exists on the photoreceptor, transfer is efficiently carried out and faithfully reproduced images may be formed on the support without exhibiting a so-called "repellency".

In an image forming method, in which after an electrostatic latent image formed on an electrostatic latent image forming body is developed employing a developer material comprising a toner, the toner remaining on the electrostatic latent image forming body is recovered during cleaning, and the recovered toner is returned to the development process and reused, the toner is one which is comprised of at least colorant particles prepared by fusing resin particles in a water-based medium, and external additives.

External additives are powders and preferably have a number average primary particle diameter of 5 to 500 nm.

The electrostatic latent image forming body is a photoreceptor, and its surface layer preferably comprises at least a compound comprising either a fluorine atom or a silicone atom.

In a process cartridge employed in an image forming apparatus, in which after an electrostatic latent image formed on an electrostatic latent image forming body, is developed employing a developer material comprising a toner, any toner remaining on said electrostatic latent image forming body is recovered during cleaning, and the recovered toner is returned to the development process and reused, a process cartridge which is constituted as a unit integrally comprised of at least a development unit comprising as said developer material a toner comprised of at least colorant particles prepared by fusing resin particles in a water-based medium and an external A additive, a cleaning unit, and a toner recycling member.

DETAILED DESCRIPTION OF THE INVENTION

Figure 1:
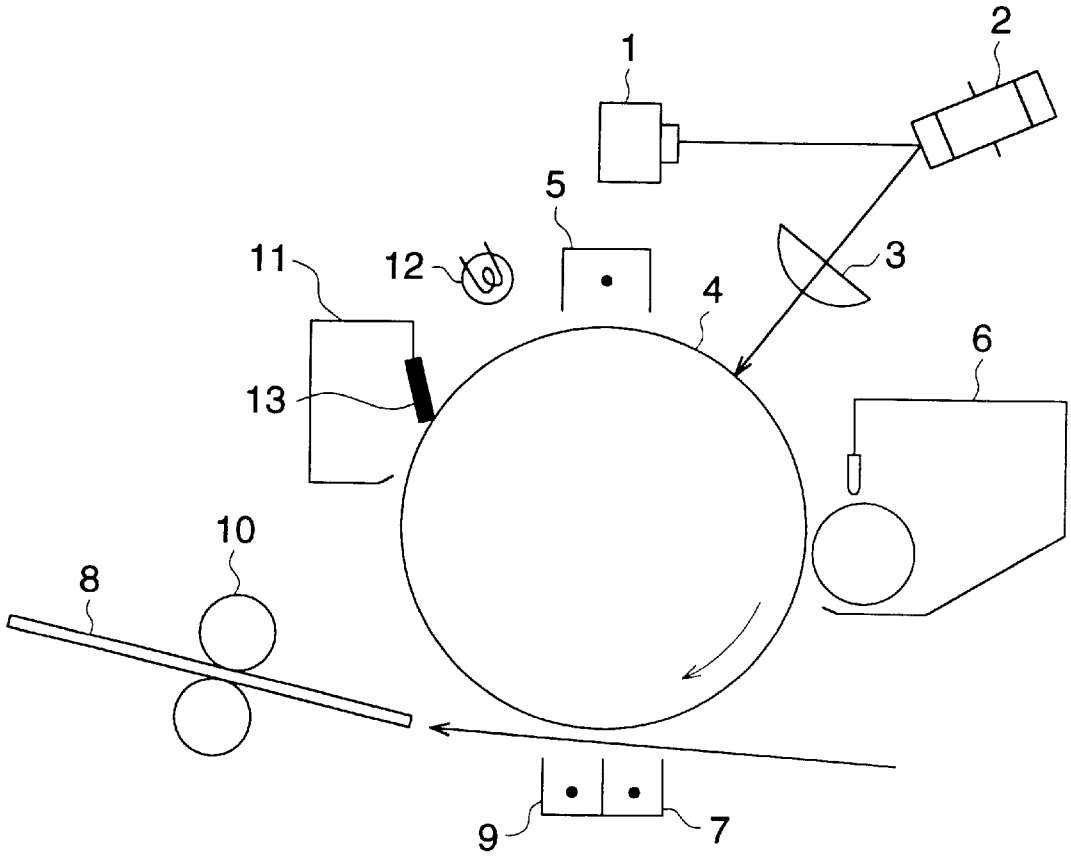
FIG. 1 is a cross-sectional construction view showing one example of the image forming apparatus of the present invention.

The average particle diameter of the toner obtained by fusing colored particles is preferably between 3 and 9 $\mu$m. The volume average particle diameter of the toner may be measured employing a Coulter Counter TA-II, a Coulter Multisizer or SLAD1100, a laser diffraction particle size analyzer manufactured by Shimadzu Mfg., Co., LTD. The average particle size is measured in the particle size range of 2.0 to 40 $\mu$m by employing an aperture of 100 $\mu$m when using Coulter Counter TA-II, a Coulter Multisizer.

As can be clearly seen from the above-mentioned definition of the shape coefficient of colored particles, the shape coefficient as described herein represents the degree of completeness of a circle having the maximum diameter, and an index showing the degree of roundness of a colored particle. The shape coefficient of a particle approaching a circle nears 1. As the shape of a particle is deformed from a circle (including an ellipse), the value increases.

A toner for developing electrostatic images is employed in which the ratio of colored particles having a shape coefficient of 1.3 to 2.2. The ratio of colored particles having a shape coefficient of 1.5 to 2.0 is at least 80 percent by number.

In order to obtain this shape coefficient, colored particles are magnified 500 times employing a scanning type electron microscope and their image is photographed. Subsequently, employing the resulting electronmicrograph, the photographic image is analyzed, using "SCANNING IMAGE ANALYSER" (manufactured by Nippon Denshi Co.). At the time, a figure, which is statistically meaningful, for example 500 colored particles, is employed. The shape coefficient is calculated by the formula described below.

$$\text{Shape coefficient}=[(\text{maximum diameter}/2)^2\times\pi]/\text{projection area}$$

When particles having a shape coefficient of less than 1.3 are incorporated (herein "are incorporated" means that at least 3 particles are substantially incorporated into the above-mentioned 500 particles), fluidity as powder increases due to the fact that the shape of the particles approaches a sphere, resulting in advantages in conveying properties, developability, and the like. However, on the contrary, during transfer, transfer repellency tends to result, and the image quality tends to be degraded. In addition, in the case of carrying out toner recycling, external additives are likely buried into the toner surface during toner recycling as the particle shape approaches a sphere. As a result, the developability as well as the transfer ratio of the recycled toner is deteriorated. Further, its adhesion power to the photoreceptor increases and cleaning problems tend to occur. On the other hand, when incorporating toner having a shape coefficient of no less than 2.2, the ratio of colored particles having an undefined shape increases and the developability is deteriorated. Further, when a toner being recycled is subjected to mechanical stress, toner particles are pulverized and fine powder is likely formed. Furthermore, when the ratio of colored particles having a shape coefficient in the range of 1.5 to 2.0 is below 80 percent by number, the distribution of charge amount and the like is broadened due to the increase in the ratio of particles having different shapes. As a result, transfer and the like are adversely affected, and it is impossible to improve the image quality. The ratio of particles having a shape coefficient of 1.5 to 2.0 is preferably at least 85 percent by number, and is more preferably at least 90 percent by number.

In order to obtain the colored particles of the present invention, a method is preferably employed in which resin particles, prepared employing a so-called polymerization method, are fused.

For example, in order to make the shape uniform, it is preferred that a nearly uniform shape is formed by fusing resin particles prepared by a polymerization method, and further, the shape of the obtained colored particles may be made more uniform through drying them in a fluidized state during drying.

Employed as polymerization methods may be either a suspension polymerization method, in which a toner is prepared in such a manner that toner components such as colorants, releasing agents, and the like are dispersed into polymerizable monomers employed to prepare a resin, and after forming a suspension in water employing the resulting dispersion, particles in the suspension undergo polymerization, or a so-called emulsion association type in which toner is prepared in such a manner that resin particles are prepared by emulsion polymerization, and the resulting resin particles are mixed with toner components comprising colorants and the like to undergo unification of particles.

The emulsion association type is more suitable. In the suspension polymerization method, the shape of particles becomes spherical. Accordingly, thereafter, a pulverizing process and the like becomes necessary, and problems may occur in which, during the pulverizing process, the shape uniformity is lost due to impact forces.

The toner particles of the present invention preferably have a so-called undefined shape preferably as well as a uniform shape. Specifically, the preparation of such toner particles may be preferably accomplished employing a method in which colored particles fused with resin particles prepared by the polymerization method are dried in a stream of heated air.

Though the reason is not fully understood, it is assumed that due to the fact that heat drying is carried out in a stream of air under the state of the excessive presence of water and in an extremely minute area, as portions swelled with water are heated, shape variation occurs, and as a result, the shape becomes uniform. When carrying out such heating, a heating process in a stream of air is preferably carried out in a falling rate drying stage.

During such drying, at least 10 percent by weight of water with respect to colored particles is preferably present. Owing to heating in a stream of air, problems occasionally occur in which when particles themselves are heated at a relatively high temperature, the shape is varied to sphere, the surface composition is subjected to variation, and the like. Therefore, colored particles comprising at least 10 percent by weight of water are preferably employed so that the particles are not heated to a temperature at which the particles themselves are softened. In this method, heating is not carried out until the temperature at which particles themselves are softened, and variation of the shape to a sphere is not enhanced.

Further, water content is preferably no more than 50 percent by weight. When water content is more than that, heat transmission becomes insufficient, and occasionally it may be difficult to make the shape uniform.

Listed as examples of flash dryers which are preferably employed for such drying are a so-called spray drying unit, a vibrating fluidized bed dryer, a high speed fluidized dryer, a flash jet dryer, and the like. In this case, the temperature of said air stream is preferably between 30 and 200° C.

The toner employed in the present invention is preferably one comprised of colored particles prepared by fusing resin particles in a water-based medium and external additives. The toner employed in the present invention may be prepared by fusing resin particles comprising a colorant in a water-based medium, or may be prepared by fusing resin particles with colorant particles in a water-based medium. From the viewpoint of production stability, toner is more preferred which is prepared by fusing resin particles with colorant particles in a water-based medium. Said toner possesses an undefined shape from its production, which is different from the undefined shape formed by the surface treatment of conventional suspension-polymerized toner, and does not generate fine powder due to friction and impact in the development unit. Furthermore, in the toner which is prepared by a so-called pulverizing method, problems occur in which said toner is subjected to stress from a unit such as a development unit and the like due to the presence of fine powder formed during pulverization, and the possession of square break plain structure, and generates fine powder. However, compared to these, in the toner of the present invention in which the shape is undefined by fusion, the shape is uniformly undefined without having squared portions. Therefore, no breaks are generated due to mechanical stress during the recycling process and no fine toner powder is generated. As a result, by reusing the recycled toner, neither a decrease in toner transfer ratio nor defective cleaning results.

Further, since fusion is carried out in a water-based medium, no fine toner particles are generated, and further, no differences in shapes and surface properties among toner particles tend to result. As a result, the charge amount distribution is narrowed, and it is possible to obtain finished images with excellent definition exhibiting minimal toner scattering.

Cited as methods to carry out fusion in a water-based medium are those described in, for example, Japanese Patent Publication Open to Public Inspection Nos. 63-186253, 63-282749, 7-146583, and the like, one in which resin particles are formed employing salting-out/fusion, or the like.

Further, in the present invention, inorganic particles having a diameter of 5 to 500 nm are preferably employed as external additives. By employing inorganic particles having such a range as external additives of a toner, it is possible provide suitable fluidity to the toner. Thus it is possible to provide the appropriate toner with appropriate fluidity, and further to decrease stress during toner recycling. As a result, it is possible to provide a toner suitable for the toner recycling system.

The weight average particle diameter of resin particles employed for producing said toner is preferably between 50 and 2,000 nm. These resin particles may be prepared by any of the several graining polymerization methods such as emulsion polymerization, suspension polymerization, seed polymerization, and the like. However, the emulsion polymerization is most preferably employed in the present invention.

Material and preparation process of the emulsion polymerization of resin particles are described. Monomer Material Radical polymerizable monomer is necessary component, and crosslinking agent may be employed when necessary as the polymerizable monomer. It is preferred to contain at least one of the following radical polymerizable monomer having acid group or base group.

(1) Radical Polymerizable Monomer

Radical polymerizable monomer is employed without restriction. One, two or more monomers are employed in combination so as to satisfy the required characteristics.

Practically, aromatic vinyl monomer, (meta)acrylate monomer, vinyl ester monomer, vinyl ether monomer, monoolefin monomer, diolefin monomer, halogenated olefin monomer etc. are exemplified.

Examples of the aromatic vinyl monomer are styrene or styrene derivatives such as styrene, o-methylstyrene, m-methylstyrene, p-methylstyrene, p-methoxylstyrene, p-phenylstyrene, p-chlorostyrene, p-ethylstyrene, p-n-butylstyrene, p-t-butylstyrene, p-n-hexylstyrene, p-n-octylstyrene, p-n-nonylstyrene, p-n-decylstyrene, p-n-dodecylstyrene, 2,4-dimethylstyrene, 3,4-dichlorostyrene.

Examples of the (meta)acrylic acid ester are methylacrylate, ethylacrylate, butylacrylate, 2-ethylhexylacrylate, cyclohexylacrylate, phenylacrylate, methylmethacrylate, ethylmethacrylate, butylmethacrylate, 2-ethylhexylmetaacrylate, β-hydroxyaethacrylate, 7-aminopropylacrylate, stearylmethacrylate, dimethylaminoethyl methacrylate, and diethylaminoethyl methacrylate.

Examples of the vinyl ester monomer are vinyl acetate, vinyl propionate and vinyl benzoate.

Examples of the vinyl ether monomer are vinyl methyl ether, vinyl ethyl ether, vinyl isobutyl ether and vinyl phenyl ether.

Examples of the monoolefin monomer are ethylene, propylene, isobutylene, 1-butene, and 1-pentene4-methyl-1-pentene.

Examples of the diolefin monomer are butadiene, isoprene, and chloroprene.

Examples of the halogenated olefin monomer are vinyl chloride, vinylidene chloride, vinyl bromide.

(2) Crosslinking Agent

Radical polymerizable crosslinking agent can be added so as to improve toner characteristics. Examples of the radical polymerizable crosslinking agent are those having two or more unsaturated bonds such as divinylbenzene, divinylnaphthalene, divinylether, diethyleneglycol methacrylate, ethyleneglycol dimethacrylate, polyethyleneglycol dimethacrylate and diallyl phthalate.

(3) Radical Polymerizable Monomer having Acid Group or Base Group

Examples of the radical polymerizable monomer having acid group or base group are carboxyl group containing monomer, sulfonic acid containing monomer, and amine compound such as primary amine, secondary amine, tertiary amine, quaternary amine.

Examples of the carboxyl group containing monomer are acrylic acid, methacrylic acid, fumaric acid, maleic acid, itaconic acid, cinnamic acid, maleic monobutylate, maleic monooctylate.

Examples of the sulfonic acid group containing monomer are styrenesulfonic acid, allylsulfosuccinic acid, octyl allylsulfosuccinate. These may be in the form of alkalimetal salt such as sodium and potassium, or alkali earth metal salt such as calcium.

Examples of the radical polymerization monomer containing base is listed as amine compounds, specifically, dimethylaminoethylacrylate, dimethylaminoethylmetacrylate, diethylaminoethylacrylate, diethylaminoethylmetacrylate, and quaternary ammonium slat of the above four compounds, 3-dimethylaminophenylacrylate, 2-hydroxy-3-methacryloxy propyl trimethylammonium salt, acrylamide, N-butylacrylamide, N, N-dibutyl acrylamide, piperidyl acrylamide, metacrylamide, N-butylmetacrylamide, N-octadecyl acrylamide; vinyl N-methylpyridinium chloride, vinyl N-ethyl pyridinium chloride, N, N-diallyl methylammonium chloride and N, N-diallyl ethylammonium chloride.

As for the amount of the radical polymerization monomer, radical polymerizable monomer containing acid group or base group is 0.1 to 15 weight % with reference to the total amount of the monomers. The amount of the radical polymerization crosslinking agent, which varies depending on its property, is 0.1 to 10 weight % with reference to the whole radical polymerizable monomers.

Chain Transfer Agents

Aiming at the adjustment of molecular weight, generally used chain transfer agents may be employed.

The chain transfer agents are not specially limited. Examples include mercapatans such as octylmercaptan, dodecylmercaptan, tert-dodecylmercapatan, etc.

Polymerization Initiators

Water-soluble radical polymerization initiators may be optionally employed in the present invention. For example, are listed persulfate salts (potassium persulfate, ammonium persulfate, etc.), azo series compounds (4,4'-azobis-4-cyano valeic acid and its salt, 2,2'-azobis(2-amodinopropane) salt, etc. peroxide compounds.

Furthermore, the above-mentioned radical polymerization initiator may be employed in combination with a reducing agent if desired, and may be employed as a redox system initiator. The use of the redox system initiator enables the increase in polymerization activity and the decrease in polymerization temperature. As a result, the reduction in polymerization time may be expected.

The polymerization temperature is not limited if the temperature is higher than the lowest temperature at which the polymerization initiator induces the formation of a radical. The temperature range of 50 to 90° C. is employed. However, the use of the polymerization initiator such as, for example, a combination of hydrogen peroxide-reducing agent (ascorbic acid, etc.) which enables initiation at room temperature makes it possible to conduct the polymerization at room temperature or lower.

Surface Active Agents

Surface active agent is employed in polymerization using the radical polymerizable monomer.

Surface active agents include sulfonic acid salts (sodium dodecylbenzenesulfonate, sodium arylalkylpolyethersulfonate, sodium 3,3-disulfondiphenylurea-4,4-diazo-bis-amino-8-naphthol-6-sulfonate, ortho-carboxybenzene-azo-dimethylaniline, sodium 2,2,5,5-tetramethyl-triphenylmethane-4,4-diazo-bis-β-naphthol-6-sulfonate, etc.), sulfonic ester salts (sodium tetradecylsulfate, sodium pentadecylsulfate, sodium octylsulfate, etc.), fatty acid salts (sodium oleate, sodium laurate, sodium caprate, sodium caprylate, sodium caproate, potassium stearate, calcium oleate, etc.)

Further, nonionic surfactant also may be employed. Examples are mentioned as polyethyleneoxide, polypropyleneoxide, combination of polypropyleneoxide and polyethyleneoxide, ester of polyethyleneglycol and higher fatty acid, alkylphenol polyethyleneoxide, ester of higher fatty acid and polyethylene glycol, ester of higher fatty acid and polypropyleneoxide, sorbitan ester.

These are mainly employed as an emulsifier during the emulsion polymerization, and may be employed in other process for other purpose.

Colorants

Colorants include inorganic pigments and organic pigments.

Inorganic Pigments p Inorganic pigments capable of employing in the toner may be employed. Specific inorganic pigments are shown in the following.

Black pigments include, for example, carbon blacks such as firness black, channel black, acetylene black, thermal black, lamp black, etc., and in addition, magnetic powders such as magnetite, ferrite, etc.

These inorganic pigments may be employed individually or in combination in accordance with requirements. Furthermore, the addition amount of the pigment is generally in the range of 2 to 20 weight parts of a polymer and preferably in the range of 3 to 15 weight parts.

Magnetite mentioned above may be added when used as a magnetic toner. Preferable amount is 20 to 60% by weight in the toner.

Organic Pigments

Organic pigments which may be employed in toner may be employed. In the following, specific organic pigments are shown.

Pigments for magenta or red include C.I. Pigment Red 2, I. Pigment Red 3, C.I. Pigment Red 5, C.I. Pigment Red 6, C.I. Pigment Red 7, C.I. Pigment Red 15, C.I. Pigment Red 16, C.I. Pigment Red 48:1, C.I. Pigment Red 53:1, C.I. Pigment Red 57:1,C.I. Pigment Red 122, C.I. Pigment Red 123, C.I. Pigment Red 139, C.I. Pigment Red 144, C.I. Pigment Red 149, C.I. Pigment Red 166, C.I. Pigment Red 177, C.I. Pigment Red 178, C.I. Pigment Red 222, etc.

Pigments for orange or yellow include C.I. Pigment Orange 31, C.I. Pigment Orange 43, C.I. Pigment Yellow 12, C.I. Pigment Yellow 13, C.I. Pigment Yellow 14, C.I. Pigment Yellow 15, C.I. Pigment Yellow 17, C.I. Pigment Yellow 93,C.I. Pigment Yellow 94, C.I. Pigment Yellow 138, etc.

Pigments for green or cyan include C.I. Pigment Blue 15, C.I. Pigment Blue 15:2, C.I. Pigment Blue 15:3, C.I. Pigment Blue 16, C.I. Pigment Blue 60, C.I. Pigment Green 7, etc.

These organic pigments may be employed individually or in combination of a plurality of them in accordance with requirements. Furthermore, the addition amount of the pigment is generally in the range of 2 to 20 weight parts for a polymer and preferably in the range of 3 to 15 weight parts.

Surface Improving Agents

The colorant may be used after subjecting to surface modification by employing surface improving agent. Specifically, may be preferably employed silane compounds, titanium compounds, aluminum compounds, etc.

The so-called external additive can be employed for the purpose of improving fluid characteristics or cleaning ability so as to give an adaptability of recycle toner. The external additive includes various inorganic particles, organic particles and lubricant.

Employed as inorganic particles used as external agents may be those having a number average primary particle diameter of 5 to 500 nm. The number average primary particle diameter as described herein denotes ones which are observed when employing a transmission type electron microscope and measured by the image analysis.

Preferably employed as inorganic particles as the external agents are various inorganic oxides, nitrides, borates and the like. For example, listed are silica, alumina, titania, zirconia, barium titanate, aluminum titanate, strontium titanate, magnesium titanate, zinc oxide, chromium oxide, cerium oxide, antimony oxide, tungsten oxide, tin oxide, tellurium oxide, manganese oxide, boron oxide, silicone carbide, boron carbide, titanium carbide, silicone nitride, titanium nitride, boron nitride, and the like.

Further, the above-mentioned inorganic particles may be those which are subjected to hydrophobic treatment. The hydrophobic treatment is preferably carried out employing so-called coupling agents, such as various titanium coupling agents, silane coupling agents, and the like, and silicone oil, and the like. Further, the hydrophobic treatment is favorably carried out employing higher fatty acid metal salts such as aluminum stearate, zinc stearate, calcium stearate, and the like.

Process of hydrophobic treatment and material employed in the process are described below.

Titanium coupling agents include tetrabutyl titanate, tetraoctyl titanate, isopropyltriisostearoyl titanate, isopropyltridecylbenzenesulfonyl titanate, bis(dioctylpyrophosphate) oxyacetate titanate, and the like. Further, listed as silane coupling agents are γ-(2-amino ethyl) aminopropyltrimethoxysilane, γ-(2-aminoethyl) aminopropyltrimethoxysilane, γ-(2-aminoethyl) aminopropylmethyldimethoxysilane, γ-methacryoxypropyltromethoxysilane, N-β-(N-vinylbenzylaminoethyl) γ-aminopropyltrimethoxysilane hydrochloride, hexamethyldisilazane, methyltrimethoxysilane, butyltrimethoxysilane, isobutyltrimethoxysilane, hexylmethoxysilane, octyltrimethoxysilane, decyltrimethoxysilane, dodecyltrimethoxysilane, phenyl trimethoxysilane, o-methylphenyltrimethoxysilane, p-methylphenyltrimethoxysilane, and the like.

Listed as fatty acids and metal salts thereof are long chain fatty acids such as undecylic acid, lauric acid, tridecylic acid, dodecylic acid, myristic acid, palmitic acid, pentadecylic acid, stearic acid, heptadecylic acid, arachic acid, montanic acid, oleic acid, linoleic acid, arachidonic acid and the like, and listed as salts thereof are salts formed with metals such as zinc, iron, magnesium, aluminum, calcium, sodium, lithium, and the like.

Listed as silicone oils can be dimethylsilicone oil, methylphenylsilicone oil, amino-modified silicone oil, and the like.

The added amount of these compounds employed for coating fine inorganic particles is preferably between 1 and 10 percent by weight of the same particles, and is more preferably between 3 and 7 percent by weight. Further, these compounds may be employed in combination.

The surface treatment can be conducted by employing polysiloxane having ammonium salt as a functional group.

Inorganic particles having different diameter within the number average primary diameter of 5 to 500 nm. Specifically, a combination of small inorganic particles and d that having large inorganic particles. The small inorganic particles have preferably number average primary diameter of 5 to 50 nm and the large inorganic particles number average primary diameter of more than 50 nm and not more than 500 nm. In the combination use of small particles and large particles, the large particles show spacer effect, by which small particles are prevented to be buried in colored particles, and toner fluidity, cleaning characteristics and durability are improved.

Organic fine particles may be added to the inorganic particles. Examples of the organic fine particles are listed as styrene resin fine particles, styrene acryl resin fine particles, polyester resin fine particles and urethane resin particles.

Composition of the organic particles is not restricted, and preferably is vinyl polymer, because it can be readily prepared by emulsion polymerization or suspension polymerization. Specific examples include styrene or styrene derivative such as styrene, a-methylstyrene, p-chlorostyrene, 3,4-dichlorostyrene, p-phenylstyrene, p-ethylstyrene, 2,4-dimethylstyrene and p-t- butylstyrene, methacryl acid ester derivative such as methylmethacrylate, ethylmethacrylate, n-butylmethacrylate, isopropylmethacrylate, 2-ethylhexylmethacrylate, acryl acid ester derivative such as methyl acrylate, ethylacrylate, isopropylacrylate, n-butylacrylate, t-butylacrylate, isobutylacrylate, n-octylacrylate and 2-ethylhexylacrylate, olefin such as ethylene, propylene and isobutylene, halogenated vinyl such as chloroethylene, vinylidenechloride, vinylbromide and vinylfluoride, fluorinated vinyl such as fluorinatedvinylidene, vinylester such as vinylpropionate and vinylacetate, vinylmethylether, vinyl ether such as vinylethylether, vinyl ketone such as vinylmethylketone, vinylethylketone and vinylhexylketone, N-vinyl compound such as N-vinylcarbazole, N-vinylindole and N-vinylpyrrolidone, vinyl compound such as vinylnaphthalene and vinylpyridine, acrylic acid derivative or methacrylic acid derivative such as acrylonitrile, methacrylonitrile, acrylamide, N-butylacrylamide, N, N-dibutylacrylamide, methacrylamide, N-butylmethacrylamide and N-octadecylacrylamide. The vinyl monomer can be employed singly or in combination.

The resin fine particles are prepared by emulsifying polymerization or suspension polymerization. The emulsion polymerization is a method in which the monomer mentioned above is polymerized after the monomer is added into water containing a surfactant and is made emulsified. The examples of surfactant employed are sodiumdodecylbenzenesulfonate, polyvinyl alcohol, adduct of ethyleneoxide, sodiumsulfate of higher alcohol. It is preferred to apply so-called non-emulsifying polymerization such as polymerization employing reactive emulsifier, polymerization of hydrophilic monomer by persulfate salt initiator such as vinyl acetate and methylacrylate, polymerization employing decompose type emulsifier, polymerization employing crosslinking emulsifier. The example of the reactive emulsifier includes sulfonic acid salt of acrylic acid amide and salt of maleic acid derivative. The non-emulsifying polymerization is preferable in case that the organic fine particles are employed solely because there is no effect of remaining emulsifier.

A radical polymerization initiator can be conveniently used. Examples of the radical polymerization initiator include peroxide such as benzoyl and lauryl peroxide, azo type initiator such as azobisisobutylnitril and azobisisovaleronitril. These are employed in an amount of 0.1 to 2 weight % to the monomer. In the emulsion polymerization potassium peroxide, sodium thiosulfate etc. may be employed as the initiator.

Example of the lubricant mentioned above includes metallic salt of higher fatty acid such as stearic acid salt of zinc, aluminum, copper and magnesium, oleic acid salt of calcium, zinc, manganese, iron, copper and magnesium, palmitic acid salt of zinc, copper, magnesium and calcium, linoleic acid salt of zinc and calcium, and ricinoleic acid salt of zinc and calcium.

The amount of the external additive is preferably 0.1 to 5 weight % with reference to toner amount.

Production Processes

Production processes of the polymerized toner of the present invention may comprise an emulsion polymerization process in which resin particles are prepared by emulsion polymerization; a process in which resin particles are fused in a water-based medium, employing the aforementioned resin particle dispersion; a washing process in which surface active agents and the like are removed by filtering the obtained particles from the water-based medium; a process for drying the obtained particles, and further an external additive adding process in which external additives and the like are added to the obtained particles, and the like. Herein, resin particles may be colored ones. Furthermore, non-colored particles may also be employed as resin particles. In this case, after colorant particle dispersion and the like are added to the resin particle dispersion, the resulting mixture is subjected to fusion in a water-based medium to enable of preparation of colored particles.

Most preferably employed as the fusing method is one in which salting-out is carried out employing resin particles prepared by the polymerization process, followed by fusion. Furthermore, when non-colored resin particles are employed, resin particles as well as colorant particles may be salted out in the water-based medium, and then fused.

Furthermore, without being limited to colorants, toner components such as a releasing agent and a charge control agent may be added during this process.

Further, the water-based medium as described herein is mainly composed of water, and implies that water content is at least 50 percent by weight. Listed as those, other than water, can be organic solvents which are soluble in water, and for examples, listed may be methanol, ethanol, isopropanol, butanol, acetone, methyl ethyl ketone, tetrahydrofuran, and the like. Alcohol based organic solvents such as methanol ethanol, isopropanol, and butanol, which do not dissolve resin, are preferred.

The colorant itself may be subjected to surface modification and then employed. A surface modifying method for colorants is carried out in such a manner that a colorant is dispersed into a solvent, and after adding a surface modifier to the resulting dispersion, the resulting mixture is heated and subsequently undergoes reaction. After completion of said reaction, filtration is carried out, washing is repeated employing the same solvent, and drying is carried out to obtain a pigment treated with the surface modifier.

Colored particles are prepared employing a method in which a colorant is dispersed into a water-based medium. Such dispersion is carried out in such a state that the concentration of the surface active agent exceeds its critical micelle concentration (CMC).

Preferably employed during dispersion of a pigment are pressure homogenizers such as an ultrasonic homogenizer, a mechanical homogenizer, a Manton-Gaulin homogenizer, a pressure type homogenizer, and the like, or medium type homogenizers such as a sand grinder, a Getzmann mill, a diamond mill, and the like.

Employed herein as surface active agents may be those described above.

During the salting-out/fusion process, salting agents comprised of alkali metal salts, alkali earth metal salts, and the like are added to water comprising resin particles as well as colorant particles so as to exceed the critical coagulation concentration as a coagulant, followed by heating the resulting mixture to a temperature exceeding the glass transition point of the resin particles, to enhance salting out as well as to proceed with fusion. In this process, a method may be employed which effectively proceeds with fusion, by substantially lowering the glass transition temperature of the resin particles with the addition of an organic solvent, which is infinitely soluble in water.

Herein, listed as alkali metals of alkali metal salts, and as alkali earth metals of alkali earth metal salts employed as salting agents are lithium, potassium, sodium, and the like, and magnesium, calcium, strontium, barium, and the like, respectively. Preferably listed are potassium, sodium, magnesium, calcium, and barium. Further, listed as components to form the salts are chloride salts, bromide salts, iodide salts, carbonate salts, sulfate salts, and the like.

Preferably listed as organic solvents, which are infinitely soluble in water, are methanol, ethanol, 1-propanol, 40 2-propanol, ethylene glycol, glycerin, acetone, and the like. Of these, alcohols such as methanol, ethanol, 1-propanol, 2-propanol are preferred, and specifically, preferred 2-propanol is.

When fusion is carried out employing salting-out followed by fusion, it is preferred to make the standing time, after adding a salting agent, as short as possible. The reason for this is not yet clear. However, it is estimated that the coagulation state varies depending on the standing time after salting out, and problems occur in which the particle diameter distribution becomes unstable and the surface properties of fused toner particles vary. The salting agent is preferably i added at a temperature below the glass transition temperature of resin particles. When the salting agent is added at a temperature exceeding the glass transition temperature of the resin particles, said resin particles are subjected to rapid salting-out/fusion. On the other hand, the particle diameter may not be controlled, and problems with the formation of particles having a large diameter occur. The temperature range during the addition of a salting agent can not be more than the glass transition temperature of resin. The temperature is generally between 5 and 55° C., and is preferably between 10 and 45° C.

It is preferred to employ a method in which a salting agent is added at a temperature below the glass transition temperature of the resin particles, thereafter the temperature is raised as quickly as possible, and the resulting mixture is heated at to least the glass transition temperature. The time of the desired temperature rise is preferably below one hour. Further, it is necessary to raise temperature rapidly, and the rate of temperature rise is preferably at least 0.25° C. per minute. The upper limit is not specifically determined. However, when the temperature is raised in an instant, problems occur in which it becomes nearly impossible to control the particle diameter, due to the fact that salting-out proceeds rapidly. The rate of temperature rise is preferably no more than 5° C./minute.

Colored Particle Preparing Process

The colored particles obtained as described above may be employed to prepare a toner without any further modification. However, for the purposes of improvements in, for example, fluidity, chargeability, and cleaning properties, the aforementioned external additives may be incorporated. Employed as methods to add the external additives, may be various mixing units such as a tabular mixer, a Henschel mixer, a nauter mixer, a V-type mixer, and the like.

Furthermore, the colored particle of the present invention may be employed individually as a magnetic or a non-magnetic single component toner, or may be employed as a two-component toner after being mixed with magnetic particles such as a carrier and the like.

Further, as toner components other than the colorant, materials which can provide various functions may be incorporated into a toner. Specifically, fixability improving agents, charge control agents, and the like are listed. These components may be incorporated employing various methods in which during the emulsion polymerization stage, a dispersion comprising any of those is added, any of these is incorporated into a toner, any of these is incorporated into resin particles themselves, and the like. Listed as preferred methods are those in which during the emulsion polymerization stage of the aforementioned resin particles, a charge control agent particle dispersion and/or a fixability improving agent particle dispersion are added, and during the aforementioned salting-out/fusing process, a resin particle dispersion as well as a colorant particle dispersion is added together with a charge control agent particle dispersion and/or a fixability improving agent particle dispersion at the same time followed by salting-out/fusion.

Employed as fixability improving agents may be those known in the art, and further, those which can be dispersed into water. Specifically listed may be olefin based waxes such as polypropylene, polyethylene, and the like, and modified compounds thereof; natural waxes such as carnauba wax, rice wax, and the like; amide based waxes such as a fatty acid bisamide and the like; and so on.

In the same manner, employed as charge control agents may be those known in the art, and which can be dispersed into water. Specifically listed are Nigrosine based dyes, metal salts of naphthenic acid or higher fatty acids, alkoxylated amines, quartenary ammonium salt compounds, azo based metal complexes, salicylic acid metal salts or metal complexes thereof, and so on.

Further, the number average primary particle diameter of particles of these charge control agents, as well as fixability improving agents, is preferably between 10 and 500 nm in its dispersed state.

Developer Material

The developer material employed in the present invention may be either a single component developer material or a two-component developer material; however, the two-component developer material is preferred. When employed as a single component developer, there is a method in which the aforementioned toner is employed as a non-magnetic single component developer material without any further modification. However, it is generally employed as single a magnetic component developer material upon incorporating magnetic particles having a size of about 0.1 to about 5 $\mu$m into the toner particles. In the same manner as for the colorant particles, magnetic particles are generally incorporated employing methods in which those are incorporated into non-spherical particles.

Furthermore, upon mixing with a carrier, the toner may be employed as a two-component developer material. In this case, employed as magnetic particles may be conventional materials known in the art, being metals such as iron, ferrite, magnetite, and the like, as well as alloys of metals such as aluminum, lead, and the like thereof. Specifically, ferrite is preferable. The volume average particle diameter is preferably between 15 and 100 $\mu$m, and is more preferably between 25 and 60 $\mu$m. The volume average particle diameter can be representatively measured by a laser diffraction grain size distribution measuring unit, "Helos" (manufactured by Sympatec Co.), equipped with a wet type homogenizer.

The carrier is preferably one which is further coated with resin, or a so-called resin-dispersed type carrier in which magnetic particles are dispersed in resin. Resins for such coating are not particularly limited. For example, employed are olefin based resins, styrene based resins, styrene/acryl based resins, silicone based resins, ester based resins, fluorine containing polymer based resins, and the like. Furthermore, resins constituting the resin-dispersed type carrier are also not particularly limited and those known in the art may be employed. For example, employed may be styrene-acrylic resins, polyester resins, fluorine based resins, phenol resins, and the like.

Image Forming Method

Next, the image forming apparatus of the present invention will be described.

FIG. 1 is a cross-sectional construction view showing an example of the image forming apparatus of the present invention. Reference numeral 4 is a photoreceptor drum which is an electrically charged body, which is prepared by forming an organic photoreceptor (OPC) as a photosensitive layer on the external circumferential surface of an aluminum drum base body, and rotates at a specified rate in the arrowed direction.

In FIG. 1, based on information read by an original document reading unit (not shown), an exposure beam is emitted from semiconductor laser beam source 1. Said exposure beam is bent perpendicular to a sheet of paper employing polygonal mirror 2, and is irradiated onto the photoreceptor surface via fθ lens 3, which corrects image deformation, to form an electrostatic latent image. Photoreceptor drum 4 is uniformly charged in advance, and starts rotating clockwise so as to match timing of the exposure beam.

An electrostatic latent image on the surface of said photoreceptor drum is developed by development unit 6, and the resulting developed image is transferred onto transfer sheet 8 conveyed in synchronized timing through the action of transfer unit 7. Further, the transfer sheet 8 is separated from the photoreceptor drum 4 employing separation unit (separation pole) 9, but the developed image is remained on the transfer sheet 8, introduced to fixing unit 10, and subsequently fixed.

Non-transferred toner, and the like, which remains on the photoreceptor surface is removed by cleaning unit 11 employing a cleaning blade method, whereby residual charge is removed by pre-charging exposure (PCL) 12, and the photoreceptor is uniformly charged by charging unit 5 for the subsequent image formation.

A method to recycle toner is not particularly limited. For example, cited may be a method in which toner recovered in a cleaning section is conveyed employing a conveyer or a conveying screw to a supplying hopper or a development unit, mixed with freshely supplied toner in an intermediate chamber and fed to the development unit. Preferably listed may be methods in which the recovered toner is directly returned to the development unit, or freshly supplied supply toner and recycled toner are mixed in an intermediate chamber and the resulting mixture is supplied.

Figure 2:
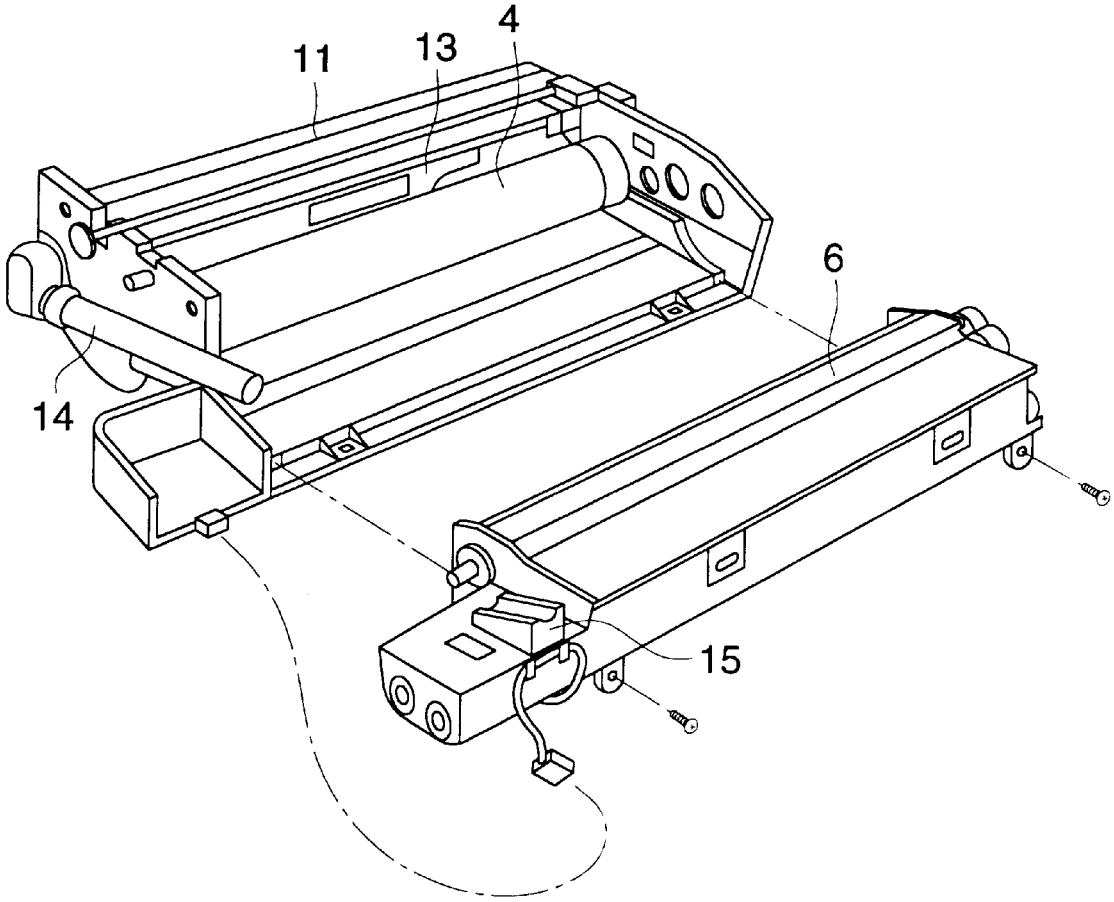
FIG. 2 is a perspective construction view of a toner recycling member.

Next, in FIG. 2, an example of a perspective construction view of a toner recycling member is shown. This method is one in which recycled toner is directly returned to the development unit.

Non-transferred toner, recovered by cleaning blade 13, is collected and stored in toner recycling pipe 14, employing a conveying screw in toner cleaning unit 11, and further is returned to development unit 5 from faucet 15 of said recycling pipe, and is repeatedly employed as a developer material.

FIG. 2 is also a perspective view of a removable process cartridge attached to the image forming apparatus of the present invention. In FIG. 2, in order to make the perspective structure more understandable, the photoreceptor unit and the developer material unit are drawn separately. However, these are integrated into one removable unit, which may be attached to the image forming apparatus. In this case, a photoreceptor, a development unit, a cleaning unit, and a recycling member are integrated into one unit to construct a process cartridge.

The image forming apparatus may have an embodiment in which a photoreceptor drum and a process cartridge comprising at least one of a charging unit, a development unit, a cleaning unit, a recycling member, or the like are installed.

Next, transfer paper, onto which after development, a non-fixed image can be transferred, is typically a sheet of plain paper, and a PET base for OHP, and the like are included.

Furthermore, the cleaning blade 13 is composed of an elastic rubber body having a thickness of about 1 to about 30 mm, and urethane rubber is most frequently employed as the material. Since said blade is employed in pressure contact with the photoreceptor, heat is readily transferred. Therefore, in the present invention, it is desirable that a releasing mechanism is provided so that a gap between said blade and the photoreceptor is formed when the image forming operation is not being carried out.

The present invention may be applied to an image forming apparatus employing an electrophotographic method, especially to an apparatus which forms an electrostatic latent image on a photoreceptor, employing a modulated beam, modulated with digital image data from a computer and the like.

In recent years, in the field of electrophotography, and the like, in which an electrostatic latent image is formed on a photoreceptor, and said latent image is developed to obtain a visible image, research and development on the image forming method are increasingly carried out, utilizing a digital system in which improvement in image quality, conversion, edition, and the like are readily carried out, so that high quality images can be formed.

As a scanning optical system which carries out light modulation based on digital image signals from a computer employed in said image forming method and apparatus or a original copying document, (1) while interposing an acoustic optical modulator in a laser optical system, an apparatus which carries out light modulation employing said acoustic optical modulator, (2) employing a semiconductor laser, there is an apparatus which directly modulates the laser intensity, and form these scanning optical systems, a spot exposure is carried out onto a uniformly charged photoreceptor to form a dot image.

The toner is advantageous particular in dot reproduction when employed in these appararus since the shape of toner is uniform.

A beam irradiated from the aforementioned scanning optical system forms a circular or elliptical luminance distribution similar to the normal distribution trailing skirts to the left and right. For example, in the case of a laser beam, the distribution forms on the photoreceptor an extremely narrow circular or elliptical shape of 20 to 100 $\mu$m in either the main scanning direction or in the secondary scanning direction.

Listed as surface materials for the photoreceptor are silicone resins, vinylidene chloride, ethylene-vinyl chloride, styrene-acrylonitrile, styrene-methyl methacrylate, styrene, polyethylene terephthalate, polycarbonate, and the like. However, said materials are not restricted to listed ones, and polymers or copolymers of other monomers, blends, and the like may be employed. Listed as the preferred material is polycarbonate, and as more a specifically preferred resin is bisphenol Z type polycarbonate.

Employed as materials of the photoreceptor holding body may be aluminum, alloys thereof, and the like.

It is common to provide an interlayer (which may also be called a sublayer) on this. As representative compositions, are ceramic based ones comprised of a silan coupling agent, an organic chelate compound, and the like, and resin based ones comprised of polyamide based resin and the like.

A photosensitive layer is provided on the sublayer. Said photosensitive layer preferably has a so-called function separating type multilayer structure comprised of a charge generating layer as well as a charge transport layer.

The charge generating layer (CGL) is frequently prepared by dispersing a charge generating material (CGM) into a binder, if desired. Employed as CGM may be azo pigments, polycyclic quinone pigments such as anthraquinone, quinoneimine pigments, azomethine pigments, cyanine pigments, benzoquinone pigments, perylene pigments, metal or metal-free phthalocyanine pigments, and the like. Furthermore, these may be employed in combination of two or more types, if desired.

Listed as binder resins employable for the charge generating layer, are for example, polystyrene resins, polyethylene resins, polypropylene resins, acrylic resins, methacrylic resins, vinyl chloride resins, vinyl acetate resins, polyvinyl butyral resins, epoxy resins, polyurethane resins, phenol resins, polyester resins, alkyd resins, polycarbonate resins, silicone resins, melamine resins, and copolymer resins comprising at least two of repeating units of these resins such as vinyl chloride-vinyl acetate copolymers, vinyl chloride-vinyl acetate-maleic anhydride copolymers, polymer organic semiconductors such as poly-N-vinylcarbazole, and the like.

The charge transport layer (CTL) is comprised of a charge transport material (CTM) alone or CTM together with a binder resin. Cited as CTM are, for example, carbazole derivatives, oxazole derivatives, oxadiazole derivatives, thiazole derivatives, thiadiazole derivatives, triazole derivatives, imidazole derivatives, imidazolone derivatives, imidazolidine derivatives, bisimidazolidine derivatives, styryl compounds, hydrazone compounds, pyrazoline derivatives, oxazolone derivatives, benzimidazole derivatives, quinazoline derivatives, benzofuran derivatives, acridine derivatives, phenazine derivatives, aminostilbene derivatives, triarylamine derivatives, phenylenediamine derivatives, stilbene derivatives, benzidine derivatives, poly-N-vinylcarbazole, poly-1-vinylpyrene, poly-9-vinylanthrathene, and the like. Further, these may be employed individually or in combination of two or more types.

Furthermore, listed as binder resins employable in the charge transfer layer are, for example, polycarbonate resins, polyacrylate resins, polyester resins, polystyrene resins, styrene-acrylonitrile copolymer resins, polymethacrylic acid ester resins, styrene-methacrylic acid ester copolymer resins, and the like. Cited as preferred resins are polycarbonate resins, and as more preferred resins are bisphenol Z type polycarbonate resins.

The electrophotographic photoreceptor employed in the present invention preferably comprises a compound having either a fluorine atom (F) or a silicone atom (Si) in a charge transport layer, or in a protective layer, which forms the surface layer of the photoreceptor. The abundance amount of the compound having a fluorine atom or a silicone atom on the surface of the photoreceptor is preferably in the following range in terms of the ratio of the fluorine atom or silicone atom to a carbon atom (C) based on XPS measurement:

F/C=0.03 to 1.00

Si/C=0.03 to 1.00

More preferably in the range of:

F/C=0.06 to 0.80

Si/C=0.06 to 0.80

Compounds having either a fluorine atom or a silicone atom, which are employed in the surface layer are exemplified below.

Specific examples of compounds having a fluorine atom, which are employed in the surface layer include ethylene tetrafluoride, ethylene trifluoridechloride, propylene hexafluoride, vinyl fluoride, vinylidene fluoride, and ethylene difluoridedichloride, from which one or more types of suitable copolymers may be selected. It is also acceptable to employ carbon fluoride and the like.

Block or graft polymers comprising a fluorine containing segment which are synthesized by polymerization or copolymerization of polymerizable monomers having a fluorine atom (fluorine based polymerizable monomers) with fluorine-free polymerizable monomers (fluorine-free based polymerizable monomer), macromonmers, and the like are employed individually or in combination with the aforementioned fluorine based resins.

Specifically, use in combination with the fluorine based graft polymer, in which a fluorine based segment continually exists, is preferred to more easily disperse the fluorine based resin as well as to more easily control the surface F/C ratio.

Specific examples of silicone atom-containing compounds which are employed in the surface layer include monomethylsiloxane three dimensionally crosslinked products, dimethylsiloxane-monomethylsiloxane three dimensionally crosslinked products, ultrahigh molecular weight polydimethylsiloxane, block polymers comprising polydimethylsiloxane segment, graft polymers, surface active agents, macromonomers, end-modified polydimethylsiloxane, and the like.

Compounds may also be employed which have a polycarbonate structure comprising a silicone atom.

Fluorine based or silicone based polymers are preferably selected from those which are compatible with the resin layers of a charge transport layer and/or a protective layer into which said resins are incorporated, or which are not perfectly compatible, have a similar structure, and exhibit affinity between them.

When the aforementioned fluorine based or silicone based polymer is incorporated into a charge transport layer or a protective layer which forms the surface layer of an electrophotographic photoreceptor, these polymers or polymers which have excellent compatibility with charge transport materials or other additives which are simultaneously present are also employed in combination. Of these fluorine-free based or silicone-free based polymers, polymers which are most preferably employed are polycarbonates which are soluble in aromatic hydrocarbon based solvent or halogenated aromatic hydrocarbon based solvents.

The weight average molecular weight of the polycarbonates is preferably at least 10,000, and is more preferably at least 20,000.

EXAMPLES

Next, the embodiments of the present invention will be further described. "Parts" means weight parts unless otherwise specified.

Example 1

1. Preparation of a Polymer Slurry

After mixing 98.1 g of styrene, 18.4 g of n-butyl acrylate, 6.1 g of methacrylic acid, 3.3 g of t-dodecylmercaptan, and 85 ml of degassed pure water, the resulting mixture heated to 80° C., while stirring under a flow of nitrogen. Subsequently, 200 ml of pure water in which 4.1 g of potassium persulfate was dissolved, was added, and the mixture underwent reaction at 80° C. for 6 hours to prepare a fine polymer particle dispersion. This was designated as "Fine Polymer Particle Dispersion 1".

Low molecular weight polypropylene (having a number average molecular weight of 3,200) was emulsified into water while being heated, employing a surface active agent to prepare an emulsified dispersion having a solid portion concentration of 20 percent by weight. At room temperature, 43 g of the resulting low molecular weight polypropylene emulsified dispersion was added to the aforementioned "Fine Polymer Particle Dispersion 1" and further, 100 ml of a dispersion (having a carbon black concentration of 10 percent by weight) prepared by dispersing carbon black employing a surface active agent, was added to the resulting mixture to prepare said dispersion.

Added to 600 ml of the resulting dispersion were 40 ml of pure water in which 160 ml of 2.7 mole percent aqueous potassium chloride solution, 94 ml of isopropyl alcohol, and 5.4 g of polyoxyethyleneoctyl phenyl ether (whose average degree of polymerization of ethylene oxide was 10) were dissolved. Thereafter, the resulting mixture was heated to 85 ° C. and underwent reaction for 6 hours. After completion of the reaction, the reacted solution was filtered and the resulting product was washed with water. The washed product was designated by "Polymer slurry 1". The water content of the product, which was measured by a drying loss method, was 38 percent by weight.

Further, polymer slurries (Polymer Slurries 2 through 4) having different water contents were prepared while the varying filtering conditions. Furthermore, polymer slurries (Polymer Slurries 5 through 8) having different shapes were prepared while varying associating conditions, e.g. the temperature and the temperature maintaining time.

TABLE 1

| Polymer No. | Water Content |
|---|---|
| Polymer Slurry 1 | 38% by weight |
| Polymer Slurry 2 | 20% by weight |
| Polymer Slurry 3 | 42% by weight |
| Polymer Slurry 4 | 78% by weight |
| Polymer Slurry 5 | 39% by weight |
| Polymer Slurry 6 | 39% by weight |
| Polymer Slurry 7 | 39% by weight |
| Polymer Slurry 8 | 38% by weight |

Subsequently, the resulting slurry was dried employing a fluidized bed dryer. Drying conditions are shown in the table below.

The supplied air temperature as described herein represents the temperature of air which is supplied so as to float particles into the fluidized bed dryer, and the exit air temperature as described herein represent the temperature of ejected air, and shows the temperature at the completion of drying.

TABLE 2

| Polymer No. | Slurry | Supplied Air Temperature | Exit Air Temperature |
|---|---|---|---|
| Polymer 1 | Polymer Slurry 1 | 65° C. | 55° C. |
| Polymer 2 | Polymer Slurry 2 | 65° C. | 55° C. |
| Polymer 3 | Polymer Slurry 3 | 65° C. | 55° C. |
| Polymer 4 | Polymer Slurry 4 | 65° C. | 55° C. |
| Polymer 5 | Polymer Slurry 1 | 80° C. | 80° C. |
| Polymer 6 | Polymer Slurry 5 | 65° C. | 55° C. |
| Polymer 7 | Polymer Slurry 6 | 65° C. | 55° C. |
| Polymer 8 | Polymer Slurry 8 | 65° C. | 55° C. |

Further, the shape coefficient of the polymer was obtained. Particles were photographed by a scanning electron microscope at a magnification of 500. The shape coefficient was calculated by "SCANNING IMAGE ANALYSER" (manufactured by Nippon Denshi Co.) employing 500 particles on the resulting electronmicrograph.

TABLE 3

| Polymer No. | Arithmetic Average of Shape Coefficients | Ratio of Particles having a Shape Coefficient of 1.5 to 2.0 | Volume Average Particle Diameter (μm) | Remarks |
|---|---|---|---|---|
| Polymer 1 | 1.88 | 95% by number | 6.9 | for Present Invention |
| Polymer 2 | 1.69 | 92% by number | 6.7 | for Present Invention |
| Polymer 3 | 1.92 | 86% by number | 6.8 | for Present Invention |
| Polymer 4 | 1.89 | 82% by number | 7.2 | for Present Invention |
| Polymer 5 | 1.28 | 35% by number | 6.5 | for Comparison |
| Polymer 6 | 1.88 | 69% by number | 6.3 | for Comparison |
| Polymer 7 | 1.59 | 82% by number | 6.9 | for Present Invention |
| Polymer 8 | 1.93 | 81% by number | 6.8 | for Present Invention |

Toners were obtained by adding each of the aforementioned "Polymers 1 through 8 with 1 percent by weight of hydrophobic silica (having an average primary particle diameter of 12 nm). The resulting toners were designated as "Toners 1 through 8".

Evaluation (of a Non-contact Development System) The aforementioned toner was mixed with a ferrite carrier having a volume average particle diameter of 50 μm, which had been coated with styrene-acrylic resin, and a developer material having a toner concentration of 7 percent by weight was prepared and employed for evaluation. Further, developer materials corresponding to the aforementioned "Toners 1 through 8" were designated as "Developer Materials 1 through 8".

Evaluation was carried out employing a modified digital color copier Konica 9028 manufactured by Konica Corp. Conditions are described below. Employed as the photoreceptor was a multilayer type organic photoreceptor.

Surface electric potential of the photoreceptor: −550 V

DC bias: −250 V

AC bias: Vp-p: −50 to −450 V

Alternating electric field frequency: 1,800 Hz

Dsd: 300 μm

Pressure regulating force: 10 gf/mm

Pressure regulating rod: SUS416 (stainless steel)/3 mm diameter

Thickness of developer material layer: 150 μm

Diameter of development sleeve: 20 mm

Further, the fixing unit had, as an upper roller, a cylindrical iron having a diameter of 30 mm of which surface was coated with a tetrafluoroethylene-perfloroalkyl vinyl ether copolymer, in the interior of which a heater was installed, and a lower roller having a diameter of 30 mm comprised of silicone rubber, of which surface was similarly coated with a tetrafluoroethylene-perfloroalkyl vinyl ether copolymer. The line pressure was set at 0.8 kg/cm and the nip width was set to be 4.3 mm. Employing said fixing unit, the printing line speed was set at 90 mm/second. Further, employed as a cleaning mechanism of the fixing unit was one equipped with a pad impregnated with silicone oil. Furthermore, the surface temperature of the cleaning unit was set at 180° C.

Employed as transfer paper was paper having a ream weight of 55 kg, and images were formed in the longitudinal direction of the paper. Further, image formation was carried out under conditions of normal temperature as well as normal humidity (25° C. and 55% RH). As an evaluation item, image sharpness was evaluated referring to fine line reproduction. This evaluation was carried out by counting the number of reproduced lines per mm, and the evaluation was carried out for both sharpness of fine lines in the longitudinal direction as well as in the lateral direction based on the conveying direction of the transfer paper. In practice, employing a magnifying lens of a power of 10, images were compared and the maximum number of lines per mm which were capable of being discriminated as a continuous line without any discontinuity, were compared.

Further, employing an image having a pixel ratio of 5 percent, 100,000 sheets of paper were successively printed at normal temperature and humidity, and images after printing said 100,000 sheets were also evaluated in the same manner.

The results are shown below.

TABLE 4

| | Number of Fine Lines (Initial) | | Number of Fine Lines (after printing 100,000 sheets) | | |
|---|---|---|---|---|---|
| Developer Material No. | Longitudinal Direction | Lateral Direction | Longitudinal Direction | Lateral Direction | Remarks |
| Developer Material 1 | 7.0 lines | 7.0 lines | 7.0 lines | 6.5 lines | for present invention |
| Developer Material 2 | 7.0 lines | 6.5 lines | 6.5 lines | 6.5 lines | for present invention |
| Developer Material 3 | 6.5 lines | 6.5 lines | 6.0 lines | 6.0 lines | for present invention |
| Developer Material 4 | 6.0 lines | 6.0 lines | 6.0 lines | 6.5 lines | for present invention |
| Developer Material 5 | 4.5 lines | 3.5 lines | 3.5 lines | 3.0 lines | for comparison |
| Developer Material 6 | 4.5 lines | 4.0 lines | 3.5 lines | 3.0 lines | for comparison |
| Developer Material 7 | 6.5 lines | 6.0 lines | 6.0 lines | 5.5 lines | for present invention |
| Developer Material 8 | 7.0 lines | 7.0 lines | 7.0 lines | 6.5 lines | for present invention |

As can clearly be seen from Table 4, it is found that those of the present invention are excellent in resolving power.

Evaluation (of a Contact Development System)

Subsequently, evaluation was carried out employing a contact development system. The aforementioned toner was mixed with a ferrite carrier having a volume average particle diameter of 65 μm, which had been coated with styrene-acrylic resin, and a developer material having a toner concentration of 5 percent by weight was prepared and employed for evaluation. Further, developer materials corresponding to the aforementioned "Toners 1 through 8" were designated as "Developer Materials 9 through 16".

Evaluation was carried out employing a modified digital color copier Konica 9028 manufactured by Konica Corp. Conditions are described below. Employed as the photoreceptor was a multilayer type organic photoreceptor.

Surface electric potential of photoreceptor: −700 V

DC bias: −500 V

Dsd: 600 μm

Regulation of developer material layer: magnetic H-Cut system

Thickness of developer material layer: 150 μm

Diameter of development sleeve: 20 mm

Further, the fixing unit comprised, as an upper roller, a cylindrical iron tube having a diameter of 30 mm of which surface was coated with a tetrafluoroethylene-perfloroalkyl vinyl ether copolymer, in which a heater was installed, and a lower roller having a diameter of 30 mm comprised of silicone rubber, of which surface was similarly coated with a tetrafluoroethylene-perfloroalkyl vinyl ether copolymer. The line pressure was set at 0.8 kg/cm and the nip width was set to be 4.3 mm. Employing said fixing unit, the printing line speed was set at 90 mm/second. Further, employed as a cleaning mechanism of the fixing unit was one equipped with a pad impregnated with fluorine based silicone oil. Furthermore, the surface temperature of the cleaning unit was set at 180° C.

Employed as transfer paper was paper having a ream weight of 55 kg, and images were formed in the longitudinal direction of the paper. Further, image formation was carried out under conditions of normal temperature as well as normal humidity (25° C. and 55% RH). As an evaluation item, image sharpness was evaluated referring to reproduction of fine lines. The evaluation was carried out for both sharpness of fine lines in the longitudinal direction as well as in the lateral direction based on the conveying direction of the transfer paper. In practice, employing a magnifying lens of a power of 10, images were compared and the maximum number of lines per mm which were capable of being discriminated as a continuous line without any discontinuity, were compared.

Further, employing an image having a pixel ratio of 5 percent, 100,000 sheets of paper were successively printed at normal temperature and humidity, and the images after printing 100,000 sheets were evaluated in the same manner.

The results are shown below.

TABLE 5

| | Number of Fine Lines (Initial) | | Number of Fine Lines (after printing 100,000 sheets) | | |
|---|---|---|---|---|---|
| Developer Material No. | Longitudinal Direction | Lateral Direction | Longitudinal Direction | Lateral Direction | Remarks |
| Developer Material 9 | 6.5 lines | 6.5 lines | 6.5 lines | 6.5 lines | for present invention |
| Developer Material 10 | 6.5 lines | 6.0 lines | 6.5 lines | 6.0 lines | for present invention |
| Developer Material 11 | 6.0 lines | 6.0 lines | 6.0 lines | 5.5 lines | for present invention |
| Developer Material 12 | 5.5 lines | 5.5 lines | 5.5 lines | 5.5 lines | for present invention |
| Developer Material 13 | 4.0 lines | 3.5 lines | 3.5 lines | 3.0 lines | for comparison |
| Developer Material 14 | 4.0 lines | 4.0 lines | 3.5 lines | 3.5 lines | for comparison |
| Developer Material 15 | 6.5 lines | 6.0 lines | 6.5 lines | 6.0 lines | for present invention |

TABLE 5-continued

| Developer Material No. | Number of Fine Lines (Initial) | | Number of Fine Lines (after printing 100,000 sheets) | | Remarks |
|---|---|---|---|---|---|
| | Longitudinal Direction | Lateral Direction | Longitudinal Direction | Lateral Direction | |
| Developer Material 16 | 6.5 lines | 6.5 lines | 6.5 lines | 6.5 lines | for present invention |

As can clearly be seen from Table 5, it is found that toners of the present invention are excellent in resolving power.

The present invention is capable of providing a toner for developing an electrostatic image, which has a uniform shape as well as a small diameter, while meeting needs for an increase in resolution, and an image forming method employing the same, which is capable of achieving consistently high resolution over a long period of time.

Example 2

Production of Colored Particle 1

Placed into a 20 liters plastic vessel having were 0.90 kg of Adekahope LS-90 (sodium n-dodecyl sulfate, manufactured by Asahi Denka Co.) and 10.0 liters of pure water. The resulting mixture was stirred and dissolved. Gradually added to the resulting solution was, while stirring, 1.2 kg of Regal 330R (being a carbon black, manufactured by Cabot Co.), and after addition, the resulting mixture was stirred thoroughly for one hour. Subsequently it was subjected to successive dispersion for 20 hours employing a sand grinder (a medium type homogenizer).

After dispersion, the particle diameter of the aforementioned dispersion was measured employing an electrophoresis light scattering photometer ELS-800, manufactured by Otsuka Denshi Co., and thereby the weight average particle diameter of 122 nm was obtained. Furthermore, the solid portion concentration of the aforementioned dispersion was measured employing a standing dry weight method, and 16.6 w/w percent were obtained. The resulting dispersion was designated as "Colored Dispersion 1".

Placed into a 10-liter stainless steel pot was 0.055 kg of sodium dodecylbenzenesulfonate (manufactured by Kanto Kagaku Co.), and then 4.0 liters of deionized water were added. The resulting mixture was allowed to dissolve at room temperature while stirring. The resulting solution was designated as Anionic Surface Active Agent Solution A.

Placed into a 10-liter stainless steel pot was 0.014 kg of New Koru 565C (a nonionic surface active agent), and then 4.0 liters of deionized water were added. The resulting mixture was allowed to dissolve at room temperature while stirring. The resulting solution was designated as Nonionic Surface Active Agent Solution B.

Placed into a 20-liter enameled pot were 223.8 g of potassium persulfate (manufactured by Kanto Kagaku Co.) were, and then 12.0 liters of deionized water were added. The resulting mixture was allowed to dissolve at room temperature while stirring. The resulting solution was designated as Initiator Solution C.

Placed into a 100-liter GL (glass lined) reaction vessel equipped with a temperature sensor, a cooling pipe, and a nitrogen gas introducing unit, were 3.41 kg of wax emulsion (with a number average molecular weight 3,000 polypropylene emulsion having a number average primary particle diameter of 120 nm and a solid portion concentration of 29.6 percent), Anionic Surface Active Agent Solution A, and Nonionic Surface Active Agent B, and the resulting mixture was stirred. Subsequently, 44.0 liters of deionized water were added.

After heating, by which the temperature of the liquid was raised to 75° C., Initiator Solution C was added. Thereafter, while maintaining the liquid at a temperature of 75±1° C., 12.1 kg of styrene, 2.88 kg of n-butyl acrylate, 1.04 kg of methacrylic acid, and 548 g of t-dodecylmercaptan were added.

The temperature of the liquid was further raised to 80±1° C., and stirred for 6 hours.

The temperature of the liquid was lowered below 40° C., and stirring was stopped. Filtrating was carried out employing a pore filter. The resulting product was designated as Latex 1-A.

Further, the glass transition temperature of resin particles in Latex 1-A was 57° C., the softening point thereof was 121° C., with the molecular weight distribution having a weight average molecular weight of 12,700 and a weight average particle diameter of 120 nm.

Placed into another 10-liter stainless steel pot was 0.055 kg of sodium dodecylbenzenesulfonate (manufactured by Kanto Kagaku Co.) and then 4.0 liters of deionized water were added. The resulting mixture was dissolved at room temperature while stirring. The resulting solution was designated as Anionic Surface Active Agent D.

Placed into a 10-liter stainless steel pot was 0.055 kg of sodium dodecylbenzenesulfonate (manufactured by Kanto Kagaku Co.) and then 4.0 liters of deionized water were added. The resulting mixture was allowed to dissolve at room temperature while stirring. The resulting solution was designated as Anionic Surface Active Agent E.

Placed into a 20-liter enameled steel pot was 200.7 g of potassium persulfate (manufactured by Kanto Kagaku Co.) and then 12.0 liters of deionized water were added. The resulting mixture was allowed to dissolve at room temperature while stirring. The resulting solution was designated as Initiator Solution F.

Placed into a 100-liter GL (glass lined) reaction vessel (incorporating Faudler stirring blades) equipped with a temperature sensor, a cooling pipe, a nitrogen gas introducing unit, and a comb type baffle were 3.41 kg of wax emulsion (with number average molecular weight 3,000 polypropylene emulsion having a number average primary particle diameter of 120 nm and a solid portion concentration of 29.6 percent), Anionic Surface Active Agent Solution D, and Nonionic Surface Active Agent E, and the resulting mixture was stirred. Subsequently, 44.0 liters of deionized water were added.

After heating, by which the temperature of the liquid was raised to 70° C., Initiator Solution F was added. At the time, added was a solution previously prepared by mixing 11.0 kg of styrene, 4.00 kg of n-butyl acrylate, 1.04 kg of methacrylic acid, and 9.02 g of t-dodecylmercaptan.

Thereafter, the temperature of the liquid was maintained at 72±2° C., and heating was carried out for 6 hours. The temperature of the liquid was further raised to 80±1° C., and stirred for 12 hours, while maintaining set temperature.

The temperature of the liquid was lowered to below 40° C., and stirring was stopped. Filtrating was carried out employing a pore filter. The resulting product was designated as Latex 1-B.

Further, the glass transition temperature of resin particles in Latex 1-B was 58° C., the softening point thereof was 132° C., with the molecular weight distribution having a weight average molecular weight of 245,000 and a weight average particle diameter of 110 nm.

Placed into a 35-liter stainless steel spot were 5.36 kg of sodium chloride (manufactured by Wako Junyaku Co.) as a salting agent and 20.0 liters of deionized water and the resulting mixture was allowed to dissolve while stirring. The resulting solution was designated as Sodium Chloride Solution G.

Placed into a 2-liter glass beaker was 1.00 g of FC-170 (a nonionic surface active agent, manufactured by Sumitomo-3M Co.), and 1.00 liter of deionized water was then added. The resulting mixture was allowed to dissolve while stirring. The resulting solution was designated as Nonionic Surface Active Agent Solution H.

Placed into a 100-liter SUS reaction vessel (having Faudler stirring blades) equipped with a temperature sensor, a cooling pipe, a nitrogen gas introducing unit, and a comb type baffle were 20.0 kg of Latex 1-A and 5.2 kg of Latex 1-B prepared as described above, 0.4 kg of colorant dispersion, and 20.0 kg of deionized water, and the resulting mixture was stirred. Subsequently, the resulting dispersion was heated to 40° C., and Sodium Chloride Solution G, 6.00 kg of isopropanol (manufactured by Kanto Kagaku Co.), and Nonionic Surface Active Agent Solution H were added in this order. After the mixture was kept standing for 10 minutes, it was heated to 85 ° C. over 60 minutes, was stirred at a liquid temperature of 85±2° C. for 60 minutes, and was subjected to salting-out/fusing together. Thereafter, the temperature was lowered to below 40 ° C., and stirring was stopped. The liquid was filtered employing a sieve having a sieve opening of 45 μm. The resulting filtrate was designated as Association Liquid 1.

Subsequently, employing a Nutsche, wet cake-shaped non-spherical particles were collected through filtration, and thereafter, were washed with deionized water.

After the completion of washing, the wet cake-shaped non-spherical particles were taken from the Nutsche, and were spread onto 5 full size paper vats while finely crushing. After covering said vats with sheets of craft paper, drying was carried out at 40° C. for 100 hours employing an air blowing dryer.

After the completion of drying, block-shaped non-spherical particles were pulverized employing a Henshel mixer.

The non-spherical particles obtained as described above were designated as "Colored Particle 1". Further, the resin particles as the component of "Colored Particle 1" had a weight average molecular weight of 55,000, a softening point of 125° C., a glass transition temperature of 57° C., a volume average grain diameter of 6.53 μm, and a shape coefficient of 1.92. The ratio of particles having a shape coefficient of 1.5 to 2.0 was 97 percent by number.

Production of Colored Particle 2

"Colored Particle 2" was produced in the same manner as "Colored Particle 1", except that in the production of "Colored Particle 1", the amount of dodecylmercaptan during the production of Latex 1-A was replaced with 400 g and dodecylmercaptan during the production of Latex 1-B was not employed. Further, the latexes were designated as Latex 2-A and Latex 2-B, respectively.

Further, the resin particles in Latex 2-B had a glass transition temperature of 59° C., a softening point of 136° C., and a molecular weight distribution with a weight average molecular weight of 315,000 and an average particle diameter of 115 nm.

The resin particles of the component of "Colored Particle 2" had a weight average molecular weight of 75,000, a softening point of 131° C., a glass transition temperature of 57 ° C., a volume average particle diameter of 7.24 μm, and a shape coefficient of 1.87. The ratio of particles having a shape coefficient of 1.5 to 2.0 was 94 percent by number.

Production of Colored Particle 3

Resin particles were obtained in the same manner as "Colored Particles 1" except that in the production of "Colored Particle 1", polymerizable monomers of Latex 1-B were replaced with 13.25 kg of styrene, 3.21 kg of butyl acrylate, and 0.75 kg of acrylic acid. The resulting resin particles were designated as Latex 3-B. Further, the resin particles in Latex 3-B had a glass transition temperature of 55° C., a softening point of 135° C., a weight average molecular weight of 231,000, and a weight average particle diameter of 105 nm.

Subsequently, in accordance with the production of Colored Particle 1, colored particles were obtained employing Latex 1-A and Latex 3-B. Further, non-spherical particles obtained herein were designated as "Colored Particle 3".

The resin particles of the component of "Colored Particle 3" had a weight average molecular weight of 61,000, a softening point of 125° C., a glass transition temperature of 57 ° C., a volume average particle diameter of 7.24 μm, and a shape coefficient of 1.79. The ratio of particles having a shape coefficient of 1.5 to 2.0 was 90 percent by number.

Production of Colored Particle 4

Preparation of Acidic Polar Group Containing Resin Added to a 100-liter GL reaction vessel (having Faudler stirring blades) were components described below:

| | |
|---|---|
| Styrene monomer | 60 parts |
| Butyl acrylate | 40 parts |
| Acrylic acid | 8 parts |
| Water | 100 parts |
| Nonionic emulsifier (Emulgen 950) | 1 part |
| Nonionic emulsifier (Neogen R) | 1.5 parts |
| Potassium persulfate | 0.5 part |

The aforementioned aqueous mixture underwent polymerization while stirring at 70° C. for 8 hours to obtain an acidic polar group containing resin emulsion (Latex 4) having a solid portion of 50 percent.

| Toner Preparation | |
|---|---|
| Latex 4 | 120 parts |
| Carbon black (Regal 330 R) | 5 parts |
| Chrome dye (Bontron-E81) | 1 part |
| Water | 200 parts |

The aforementioned mixture was disperse-stirred at about 25° C. for 2 hours employing a slasher. Thereafter, while further stirring, the resulting mixture was heated at 65° C. for 3 hours. The resulting liquid dispersion obtained by cooling was subjected to a glass filtration, water washing, and vacuum drying at 50° C. for 10 hours to obtain "Colored Particle 4". "Colored Particle 4" had a volume average particle diameter of 7.5 μm and a shape coefficient of 1.96. The ratio of the particles having a shape coefficient of 1.5 to 2.0 was 85 percent by number.

Production of Colored Particle 5

In accordance with Example 4 of the production of a suspension polymerized toner, a suspension polymerized toner was produced. Thereafter, fine resin particles were fused onto the surface of colored particles employing mechanochemical method and colored particles having an uneven surface were obtained.

Namely, a mixture consisting of 165 g of styrene, 35 g of n-butyl acrylate, 10 g of phthalocyanine blue, 2 g of di-t-butylsalicylic acid metal compound, 8 g of styrene-methacrylic acid copolymer, and 20 g of paraffin wax (having a melting point of 70° C.) was heated to 60° C., and was dissolve-dispersed uniformly at 12,000 rpm employing a TK homomixer (manufactured by Tokushuki Kako Kogyo). Added to the resulting dispersion were 10 g of 2,2'-azobis(2,4-valeronitrile) as a polymerization initiator, and mixed to prepare a polymerizable monomer composition. Subsequently, added to 710 g of deionized water were 450 g of 1M aqueous sodium phosphate. Gradually added to the resulting mixture were 68 g of 1.0M calcium chloride solution while stirring at 12,000 rpm employing a TK homomixer to prepare a suspension in which tricalcium phosphate was dispersed. Added to the resulting suspension was the aforementioned polymerizable monomer composition, and stirred at 10,000 rpm for 20 minutes employing a TK homomixer to granulate the polymerizable monomer composition. Thereafter, the resulting particles underwent reaction at 80° C. for 10 hours. Tricalcium phosphate was removed employing hydrochloric acid, and subsequently, filtration, washing, and drying were carried out to obtain colored particles having a number average primary particle diameter of 7.9 μm. Thereafter, added to the resulting colored particles were 2.0 percent by weight of PMMA particles having a number average primary particle diameter of 1.0 μm. The resulting mixture was subjected to mechano-mill treatment for 3 minutes at a circumferential speed of 80 m/second employing a hybridizer manufactured by Nara Kikai Seisakusho to form unevenness on the colored particle surface. Thus "Colored Particle 5" was obtained. "Colored Particle 5" had a shape coefficient of 1.19, and the ratio of particles having a shape coefficient of 1.5 to 2.0 was 10 percent by number.

Production of Colored Particle 6

A mixture consisting of 100 parts of styrene-acrylic resin, 10 parts of carbon black, and 4 parts of low molecular weight polypropylene (having a number average molecular weight of 3,000) was melted, kneaded, pulverized, and classified to obtain colored particles having a volume average particle diameter of 6.9 μm. The resulting colored particles had a shape coefficient of 2.13, and the ratio of the particles having a shape coefficient of 1.5 to 2.0 was 26 percent by number. The resulting colored particle were designated as "Colored Particle 6".

External additives shown in the table below were added to the aforementioned "Colored Particles 1 through 6", and the resulting mixture was blended employing a Henschel mixer to prepare each toner.

TABLE 6

| Toner No. | Colored Particle No. | Type and Added Amount of External Additive |
|---|---|---|
| Toner 1 | Colored Particle 1 | 1 = 1.0% |
| Toner 2 | Colored Particle 2 | 2 = 1.2% |
| Toner 3 | Colored Particle 3 | 3 = 1.0% |
| Toner 4 | Colored Particle 4 | 5 = 1.1% |
| Toner 5 | Colored Particle 1 | 6 = 1.5% |
| Toner 6 | Colored Particle 1 | 1 = 1.2%/ 7 = 1.0% |
| Toner 7 | Colored Particle 1 | 1 = 1.1%/ 8 = 1.1% |
| Toner 8 | Colored Particle 1 | 1 = 1.0%/ 9 = 1.0% |
| Toner 9 | Colored Partic1e 1 | 1 = 1.0%/10 = 1.0% |
| Comparative Toner 1 | Colored Particle 5 | 1 = 1.0%/ |
| Comparative Toner 1 | Colored Particle 6 | 1 = 1.0%/ 7 = 1.0% |

(1) hydrophobic silica (treated with dimethylchlorosilane) having a number average primary particle diameter of 12 nm (2) hydrophobic silica (treated with hexamethyldisilazane) having a number average primary particle diameter of 7 nm (3) hydrophobic silica (treated with octyltrimethoxysilane) having a number average primary particle diameter of 12 nm (4) hydrophobic titania (treated with octyltrimethoxysilane) having a number average primary particle diameter of 25 nm (5) hydrophobic silica (treated with dimethylsilicone oil) having a number average primary particle diameter of 12 nm (6) hydrophobic silica (treated with dimethylsilicone oil) having a number average primary particle diameter of 45 nm (7) hydrophobic titania (treated with octyltrimethoxysilane) having a number average primary particle diameter of 180 nm (8) hydrophobic titania (treated with octyltrimethoxysilane) having a number average primary particle diameter of 280 nm (9) hydrophobic titania (treated with stearic acid) having a number average primary particle diameter of 430 nm

(10) hydrophobic titania (treated with octyltrimethoxysilane) having a number average primary particle diameter of 560 nm Furthermore, each of these toners was mixed with a ferrite carrier coated with a styrene-acrylic resin having a volume average particle diameter of 45 μm so that toner concentration was 6 percent. Thus each of developer materials shown below was prepared.

TABLE 7

| Developer Material No. | Toner No. |
|---|---|
| Developer Material 1 | Toner 1 |
| Developer Material 2 | Toner 2 |
| Developer Material 3 | Toner 3 |
| Developer Material 4 | Toner 4 |
| Developer Material 5 | Toner 5 |
| Developer Material 6 | Toner 6 |
| Developer Material 7 | Toner 7 |
| Developer Material 8 | Toner 8 |
| Developer Material 9 | Toner 9 |
| Comparative Developer Material 1 | Comparative Toner 1 |
| Comparative Developer Material 1 | Comparative Toner 1 |

Evaluation

Evaluation was carried out employing a digital copier 7033 (using A4 size sheets of paper at 3 sheets/minute) manufactured by Konica, equipped with a toner recycling system. Employed as the photoreceptor was a multilayer organic photoreceptor described below, which had been prepared by improving an OPC for 7033.

Production Example of Photoreceptor A (the layer construction was such that onto an aluminum drum support having a diameter of 60 mm, a sublayer, a charge generating layer, a charge transport layer, and a second charge transport layer were applied in this order) The construction of the photoreceptor is shown in the following.

1: Sublayer Coating Composition

| | |
|---|---|
| Titanium chelate compound "TC-750" (manufactured by Matsumoto Seiyaku Co., Ltd.) | 30 parts |
| Silane coupling agent "KMB-503" (manufactured by Shin-Etsu Kagaku Co., Ltd.) | 17 parts |
| 2 -Propanol | 150 parts |

The coating composition described above was coated onto an aluminum support so as to form a dry layer thickness of 0.8 μm, and subsequently, onto the resulting sublayer, the CGL coating composition (which was dispersed for 20 hours employing a sand mill) described below was applied so as to form a dry layer thickness of 0.5 μm to obtain the CGL.

2: CGL Coating Composition

| | |
|---|---|
| Y-type titanylphthalocyanine (having a maximum peak wavelength of X-ray diffraction of the characteristic X-ray of Cu-Kα of 27.3° in terms of Bragg angle (2θ ± 0.2°) | 10 parts |
| Silicone resin "KR-5240" (manufactured by Shin-Etsu Kagaku Co., Ltd.) | 10 parts |
| t-Butyl acetate | 1000 parts |

After the CTL coating solution described below was coated onto the CGL described above so as to form a dry layer thickness of 23 μm, drying was carried out at 100° C. for one hour to form a CTL.

3: CTL Coating Composition

| | |
|---|---|
| CTM (CTM1 having the structure described below) | 224 parts |
| Polycarbonate Z (having Mv of 30,000, manufactured by Mitsubishi Gas Kagaku Co., Ltd.) | 560 parts |
| Irganox 1010 (manufactured by Sankyo Co., Ltd.) | 21 parts |
| 1,2-Dichloroethane | 2800 parts |

4A: Second CTL Coating Composition

| | |
|---|---|
| CTM (CTM1) | 10 parts |
| Fine carbon fluoride powder (having an average particle diameter of 0.23 μm, manufactured by Central Glass Co.) | 7 parts |
| Polycarbonate Z (having Mv of 30,000, manufactured by Mitsubishi Gas Kagaku Co., Ltd.) | 20 parts |
| Monochlorobenzene | 120 parts |

Dichloromethane 80 parts

Next, the coating composition described above was dispersed, mixed, and dissolved employing a sand mill. The resulting composition was coated onto the aforementioned CTL employing circular slide coating so as to form a dry layer thickness of 5 μm, and thus photoreceptor drum A was prepared.

Elements on the surface of photoreceptor drum A were analyzed. The result showed that the surface of the photoreceptor drum A was comprised of F atom of 8.3 percent, and C atom of 74.3 percent, and the ratio of F to C was 0.11.

CTM1

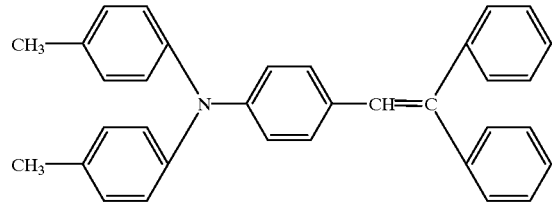

Mw = 452
(78° C.)

Production Example of Photoreceptor Drum B

The same materials as photoreceptor drum A were prepared for the production of the aluminum cylinder, the electrically conductive layer, the sublayer and the CTL layer of photoreceptor drum B.

Next, the coating composition of the second CTL, described below, was dispersed, mixed and dissolved employing a sand mill, and was coated onto the aforementioned CTL employing circular slide coating so as to provide a dry layer thickness of 5 pm. Thus photoreceptor drum B was produced.

4B: Second CTL Coating Composition

| | |
|---|---|
| CTM (CTM1) | 13 parts |
| Fine spherical three dimensionally cross-linked polysiloxane particles Having an average diameter of 0.29 μm, manufactured by Toshiba Silicone Co., Ltd.) | 5 parts |
| Polycarbonate Z (having Mv of 30,000, manufactured by Mitsubishi Gas Kagaku Co., Ltd.) | 10 parts |
| Resin (B1 having the structure described below, and Mv of 30,000) | 10 parts |
| Monochlorobenzene | 120 parts |
| Dichloromethane | 80 parts |

Elements on the surface of photoreceptor drum B were analyzed. The result showed that the surface of the photoreceptor drum A was comprised of Si atom of 8.4 percent, and C atom of 77.3 percent, and the ratio of Si to C was 0.11.

B1

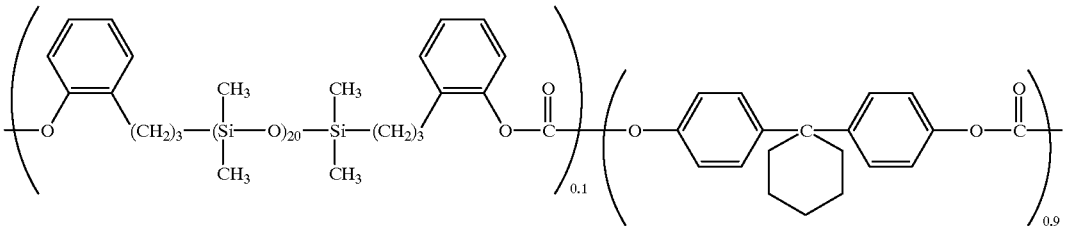

Production Example of Photoreceptor Drums C through F

The photoreceptors having the surface composition described below were obtained by varying the added amount of carbon fluoride in the second CTL coating composition of Production Example of Photoreceptor Drum A.

Photoreceptor C: the ration of F to C was 0.02

Photoreceptor D: the ration of F to C was 0.26

Photoreceptor E: the ration of F to C was 0.71

Photoreceptor F: the ration of F to C was 0.93

Production Example of Photoreceptor Drums G through J

The photoreceptors having the surface composition described below were obtained by varying the added amount of fine spherical three-dimensionally cross-linked polysiloxane particles in the second CTL coating composition in Production Example of Photoreceptor Drum B.

Photoreceptor G: the ration of Si to C was 0.02

Photoreceptor H: the ration of Si to C was 0.53

Photoreceptor I: the ration of Si to C was 0.73

Photoreceptor J: the ration of Si to C was 0.98

Photoreceptor Charging Conditions

Charging unit: scorotron

Charging voltage: photoreceptor charge potential (initial charge potential) 720 V Development Conditions DC bias: −500 V Dsd (distance between the photoreceptor and the development sleeve): 600 μm Regulation of developer material layer: magnetic H-Cut system Thickness of developer material layer: 700 μm Diameter of development sleeve: 40 mmϕ

Furthermore, as the fixing method, heat roll fixing was employed. Non-transfer toner remaining on the photoreceptor was recovered employing a blade cleaning method. The recovered toner was returned to the development unit employing the recycling member shown in FIG. 2, and was reused.

Employed as transfer paper was paper having a ream weight of 55 kg, and images were formed in the longitudinal direction. Image formation was carried out at relatively high temperature and humidity (33° C. and 85% RH). As an original image, a line image was used which had a relatively low printing ratio such as 2 percent of pixel ratio, and 50,000 sheets were printed while every two sheets were not printed. At the first and 50,000th sheet, an image comprised of solid black, solid white, and halftone was printed. The resulting prints were employed for evaluation of image density, density of background stain, and uniformity of halftone. Regarding the image density, absolute reflection density was measured employing RD-918 manufactured by Macbeth Co. The stain density was obtained as relative reflection density, when the reflection density of paper was defined as "0". Furthermore, the uniformity of halftone was visually evaluated. The evaluation was carried out based on the rank described below.

| | |
|---|---|
| Rank A: | uniform image without unevenness was observed |
| Rank B: | slight streak unevenness was observed |
| Rank C: | several lines of slight steak unevenness were observed |
| Rank D: | at least 4 lines of distinct streak unevenness were observed |

The evaluation described above was carried out in combination of developer materials and photoreceptors shown in Table 8.

The evaluation results are shown in Table 9.

TABLE 8

| Experiment No. | Developer Material No. | Photoreceptor No. |
|---|---|---|
| Example 1 | Developer material 1 | Photoreceptor A |
| Example 2 | Developer material 2 | Photoreceptor A |
| Example 3 | Developer material 3 | Photoreceptor A |
| Example 4 | Developer material 4 | Photoreceptor A |
| Example 5 | Developer material 5 | Photoreceptor A |
| Example 6 | Developer material 6 | Photoreceptor A |
| Example 7 | Developer material 7 | Photoreceptor A |
| Example 8 | Developer material 8 | Photoreceptor A |
| Example 9 | Developer material 9 | Photoreceptor A |
| Example 10 | Developer material 1 | Photoreceptor B |
| Example 11 | Developer material 1 | Photoreceptor C |
| Example 12 | Developer material 1 | Photoreceptor D |
| Example 13 | Developer material 1 | Photoreceptor E |
| Example 14 | Developer material 1 | Photoreceptor F |
| Example 15 | Developer material 1 | Photoreceptor G |
| Example 16 | Developer material 1 | Photoreceptor H |
| Example 17 | Developer material 1 | Photoreceptor I |
| Example 18 | Developer material 1 | Photoreceptor J |
| Example 1 | Developer materia1 1 | Photoreceptor A |
| Comparative Example 1 | Comparative Developer material 1 | Photoreceptor A |
| Comparative Example 2 | Comparative Developer material 2 | Photoreceptor A |

TABLE 9

| | Image Density | | Stain Density | | Halftone Image Quality | |
|---|---|---|---|---|---|---|
| Experiment No. | Initial | After Printing 50,000 Sheets | Initial | After Printing 50,000 Sheets | Initial | After Printing 50,000 Sheets |
| Example 1 | 1.42 | 1.41 | 0.001 | 0.004 | A | A |
| Example 2 | 1.43 | 1.40 | 0.001 | 0.004 | A | A |
| Example 3 | 1.42 | 1.41 | 0.001 | 0.005 | A | A |

TABLE 9-continued

| Experiment No. | Image Density Initial | Image Density After Printing 50,000 Sheets | Stain Density Initial | Stain Density After Printing 50,000 Sheets | Halftone Image Quality Initial | Halftone Image Quality After Printing 50,000 Sheets |
|---|---|---|---|---|---|---|
| Example 4 | 1.43 | 1.42 | 0.001 | 0.004 | A | A |
| Example 5 | 1.42 | 1.39 | 0.001 | 0.004 | A | A |
| Example 6 | 1.45 | 1.42 | 0.001 | 0.002 | A | A |
| Example 7 | 1.43 | 1.40 | 0.001 | 0.002 | A | A |
| Example 8 | 1.42 | 1.40 | 0.001 | 0.002 | A | A |
| Example 9 | 1.42 | 1.39 | 0.001 | 0.002 | A | A |
| Example 10 | 1.42 | 1.38 | 0.001 | 0.005 | A | A |
| Example 11 | 1.41 | 1.38 | 0.001 | 0.004 | A | B |
| Example 12 | 1.43 | 1.41 | 0.001 | 0.005 | A | A |
| Example 13 | 1.42 | 1.40 | 0.001 | 0.005 | A | A |
| Example 14 | 1.42 | 1.39 | 0.001 | 0.004 | A | B |
| Example 15 | 1.42 | 1.40 | 0.001 | 0.004 | A | B |
| Example 16 | 1.42 | 1.40 | 0.001 | 0.005 | A | A |
| Example 17 | 1.43 | 1.39 | 0.001 | 0.004 | A | A |
| Example 18 | 1.43 | 1.39 | 0.001 | 0.004 | A | B |
| Comparative Example 1 | 1.42 | 1.23 | 0.001 | 0.032 | A | C |
| Comparative Example 2 | 1.42 | 1.26 | 0.001 | 0.026 | A | C |

Being based on features in that toner, in which resin particles are fused together in an water-based medium, has a narrow particle size distribution, does not comprise toner particles having the small particle diameter, and substantially is comprised of particles in a non-spherical shape, in image formation employing a toner recycling system, background stain is not formed, and image density as well as halftone image quality is not degraded after copying 50,000 sheets. Thus it has been possible to achieve marked improvements.

What is claimed is:

1. A toner for developing an electrostatic image comprising colored particles containing a resin and a colorant, wherein the volume average particle diameter of said colored particles is 3 to 9 $\mu$m, the shape coefficient of said colored particles, which is described by the formula below, is 1.3 to 2.2, and at least 80% by number of total colored particles in the toner have a shape coefficient of 1.5 to 2.0

$$\text{Shape coefficient}=[(\text{maximum diameter}/2)^2\times\pi]/(\text{projection area}).$$

2. The toner of claim 1 wherein the colored particles comprise an external additive.

3. The toner of claim 2 wherein the external additive is inorganic particles.

4. The toner of claim 3 wherein number average primary particle diameter of the inorganic particles is 5 to 500 nm.

5. The toner of claim 4 wherein the toner comprises the inorganic particles having number average primary particle diameter of 5 to 50 nm and the inorganic particles having number average primary particle diameter of more than 50 and not more than 500 nm.

6. The toner of claim 1 wherein the colored particles are prepared by fusing resin particles in an water-based medium.

7. The toner of claim 6 wherein the colored particles are prepared by drying by stream of heated air after fusing resin particles in an water-based medium.

8. The toner of claim 6 wherein the toner comprises inorganic particles having a number average primary particle diameter of 5 to 50 nm and inorganic particles having a number average primary particle diameter of from 50 to 500 nm, and at least 90% by number of the total colored particles in the toner have a shape coefficient of 1.5 to 2.0.

9. A developer for developing an electrostatic image comprising toner comprising colored particles containing a resin and a colorant, the developer being a two-component developer comprising the toner and a carrier, wherein the volume average particle diameter of said colored particles is 3 to 9 $\mu$m, the shape coefficient of said colored particles, which is described by the formula below, is 1.3 to 2.2, and at least 80% by number of total colored particles in the toner have a shape coefficient of 1.5 to 2.0

$$\text{Shape coefficient}=[(\text{maximum diameter}/2)^2\times\pi]/(\text{projection area}).$$

10. The developer of claim 9 wherein the toner comprises the colored particles and an external additive.

11. The developer of claim 10 wherein the external additive is inorganic particles.

12. The developer of claim 11 wherein number average primary particle diameter of the inorganic particles is 5 to 500 nm.

13. The developer of claim 12 wherein the toner comprises the inorganic particles having number average primary particle diameter of 5 to 50 nm and the inorganic particles having number average primary particle diameter of more than 50 and not more than 500 nm.

14. An image forming method developing an electrostatic image by a developer containing a toner wherein the toner comprises colored particles containing a resin and a colorant, the volume average particle diameter of said colored particles is 3 to 9 $\mu$m, the shape coefficient of said colored particles, which is described by the formula below, is 1.3 to 2.2, and at least 80% by number of total colored particles in the toner have a shape coefficient of 1.5 to 2.0

$$\text{Shape coefficient}=[(\text{maximum diameter}/2)^2\times\pi]/(\text{projection area}).$$

15. The image forming method of claim 14 which comprises developing an electrostatic latent image formed on a latent image forming body by the developer comprising the toner, transferring the toner to a transfer material, and cleaning toner remaining on the latent image forming body, wherein cleaned toner is recycled.

16. The image forming method of claim 15, wherein the developer is composed of the colored particles prepared by fusing resin particles in an water-based medium and an external additive.

17. The image forming method of claim 16, wherein the external additive is inorganic particles.

18. The image forming method of claim 17, wherein number average primary particle diameter of the inorganic particles is 5 to 500 nm.

19. The image forming method of claim 18, wherein at least 90% by number of the total colored particles in the toner have a shape coefficient of 1.5 to 2.0.

* * * * *